US011817033B2

(12) United States Patent
Lin

(10) Patent No.: US 11,817,033 B2
(45) Date of Patent: Nov. 14, 2023

(54) DISPLAY DEVICE AND DISPLAY METHOD

(71) Applicant: HANNSTOUCH SOLUTION INCORPORATED, Tainan (TW)

(72) Inventor: Sheng-Chia Lin, Tainan (TW)

(73) Assignee: HANNSTOUCH SOLUTION INCORPORATED, Tainan (TW)

( * ) Notice: Subject to any disclaimer, the term of this patent is extended or adjusted under 35 U.S.C. 154(b) by 0 days.

(21) Appl. No.: 17/454,818

(22) Filed: Nov. 14, 2021

(65) Prior Publication Data

US 2023/0154375 A1 May 18, 2023

(51) Int. Cl.
*G09G 3/20* (2006.01)

(52) U.S. Cl.
CPC ..... *G09G 3/2085* (2013.01); *G09G 2330/021* (2013.01); *G09G 2340/0435* (2013.01); *G09G 2354/00* (2013.01)

(58) Field of Classification Search
CPC ..... G09G 3/2085
See application file for complete search history.

(56) References Cited

U.S. PATENT DOCUMENTS

| | | | | |
|---|---|---|---|---|
| 10,565,964 | B2 * | 2/2020 | Hicks | G09G 5/377 |
| 2008/0074444 | A1 * | 3/2008 | Morikawa | G09G 5/005 345/660 |
| 2015/0248210 | A1 * | 9/2015 | Lee | G06F 1/3265 345/593 |
| 2021/0074200 | A1 * | 3/2021 | Xiang | G09G 3/2085 |

* cited by examiner

*Primary Examiner* — Matthew Yeung
(74) *Attorney, Agent, or Firm* — CKC & Partners Co., LLC

(57) ABSTRACT

A display method includes using the processor to adjust an image signal according to a user distance between a user and the display device detected by the distance detector; and sending the adjusted image signal to the display panel, thereby causing the display panel to display an image, wherein if the user distance is in a first distance range, the image is displayed by a first proportion of the pixels of each of the blocks; and if the user distance is in a second distance range, the image is displayed by a second proportion of the pixels of each of the blocks, wherein the second distance range is less than the first distance range, and the second proportion is greater than the first proportion.

11 Claims, 20 Drawing Sheets

DISPLAY DEVICE AND DISPLAY METHOD

BACKGROUND

Field of Invention

The present invention relates to a display device and a display method.

Description of Related Art

In order to meet the requirements of modern products for high speed, high performance, lightness, thinness, and small size, various electronic components are actively developing towards miniaturization. Various portable electronic devices have become mainstream, such as: notebook computers, cell phones, personal digital assistants, tablet personal computers, or the like. For various portable electronic devices, display panels featuring miniaturization, good space utilization efficiency, high image quality, low power consumption, and no radiation, have been widely used.

Generally, a display panel is mainly formed of plural scan lines, plural data lines, and plural pixels driven by corresponding scan lines and data lines, respectively. As the resolution and refresh frequency of the display panel continue to increase, the refresh frequency of the scan line is getting faster and faster, which will increase the power consumption of the display panel. Therefore, it becomes an important subject how to reduce the power consumption of the display panel to comply with the trend of energy saving.

SUMMARY

In some embodiments of the present invention, by identifying the distance between the human eye and the panel, the resolution and scan frequency of the display panel are controlled to achieve visual comfort while saving power.

According to some embodiments of the present invention, a display method is applicable to a display device, wherein the display device comprises a display panel, a distance detector, and a processor electrically connected with the display panel and the distance detector, the display panel comprises a plurality of blocks, each of the blocks comprises a plurality of pixels. The display method includes using the processor to adjust an image signal according to a user distance between a user and the display device detected by the distance detector; and sending the adjusted image signal to the display panel, thereby causing the display panel to display an image, wherein: if the user distance is in a first distance range, the image is displayed by a first proportion of the pixels of each of the blocks; and if the user distance is in a second distance range, the image is displayed by a second proportion of the pixels of each of the blocks, wherein the second distance range is less than the first distance range, and the second proportion is greater than the first proportion.

In some embodiments, the blocks have a same shape. In some embodiments, the first proportion of the pixels of each of the blocks have a same shape with the blocks. In some embodiments, the second proportion of the pixels of each of the blocks have a same shape with the blocks. In some embodiments, if the user distance is in a third distance range, the image is displayed by a third proportion of the pixels of each of the blocks, wherein the third distance range is less than the second distance range, and the third proportion is greater than the second proportion. In some embodiments, the third proportion is 100%. In some embodiments, adjacent two of the blocks are aligned with each other along a first direction, and adjacent two of the blocks are aligned with each other along a second direction orthogonal to the first direction. In some embodiments, adjacent two of the blocks are aligned with each other along a first direction, and adjacent two of the blocks are misaligned along a second direction orthogonal to the first direction. In some embodiments, the blocks are in a shape of a square, a rectangle, a parallelogram, or a diamond.

According to some embodiments of the present invention, a display device includes a display panel, a distance detector, and a processor. The display panel includes plural blocks, each of the blocks includes plural pixels. The processor is electrically connected with the display panel and the distance detector. The processor is configured to adjust an image signal according to a user distance between a user and the display device detected by the distance detector; and send the adjusted image signal to the display panel to display an image. If the user distance is in a first distance range, the display panel displays the image by a first proportion of the pixels of each of the blocks. If the user distance is in a second distance range, the display panel displays the image by a second proportion of the pixels of each of the blocks. The second distance range is less than the first distance range, and the second proportion is greater than the first proportion.

In some embodiments, if the user distance is in a third distance range, the processor controls the display panel to display the image by a third proportion of the pixels of each of the blocks, wherein the third distance range is less than the second distance range, and the third proportion is greater than the second proportion.

BRIEF DESCRIPTION OF THE DRAWINGS

Aspects of the present invention are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

The following invention provides many different embodiments, or examples, for implementing different features of the provided subject matter. Specific examples of components and arrangements are described below to simplify the present invention. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact.

Figure 1A:
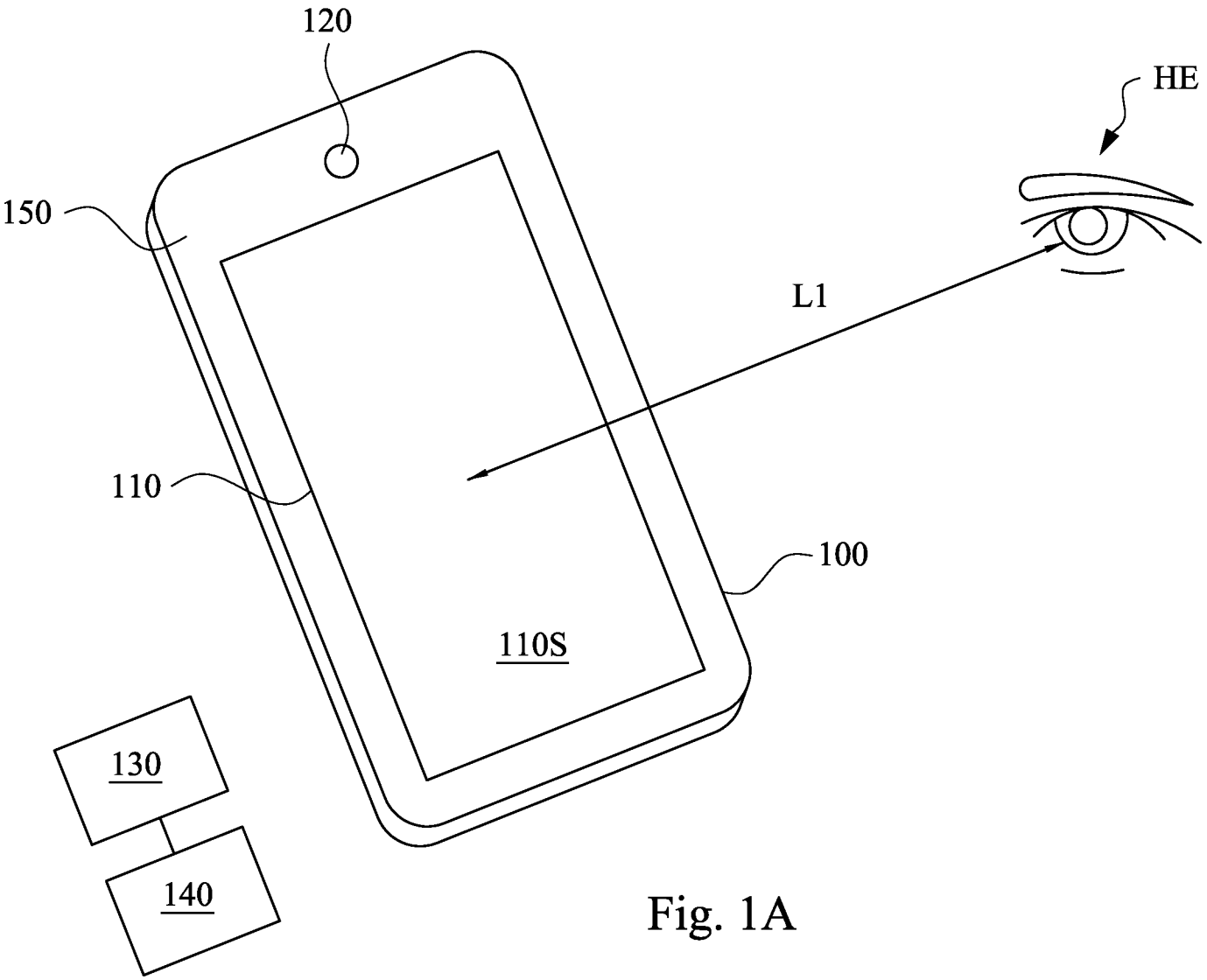
FIG. 1A is an application illustration of a display device according to some embodiments of the present invention.
Figure 1B:
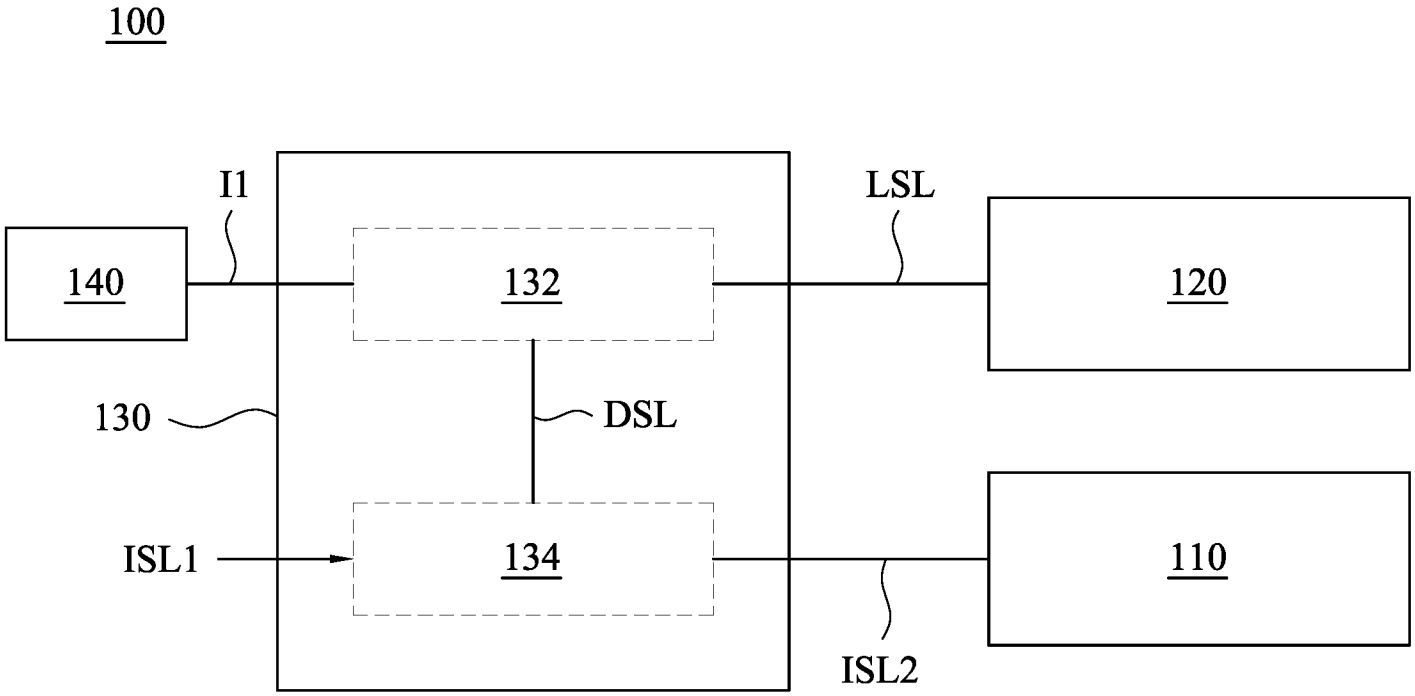
FIG. 1B is a block diagram of the display device of FIG. 1A.

FIG. 1A is an application illustration of a display device 100 according to some embodiments of the present invention. FIG. 1B is a block diagram of the display device 100 of FIG. 1A. The display device 100 can be applicable to devices such as mobile phones, monitors (e.g., computer screens), and televisions. The display device 100 includes a display panel 110, a distance detector 120, a processor 130, an input device 140, and a housing 150. In some examples, the display panel 110, the distance detector 120, the processor 130, and the input device 140 may be contained in the housing 150.

In some embodiments, the display panel 110 has a display surface 110S facing an user. The display panel 110 may be a liquid crystal display (LCD), a light-emitting diode (LED) panel, or an active-matrix organic light-emitting diode (AMOLED) panel, but not limited thereto.

The distance detector 120 may face the same direction as the display surface 110S does, thereby detecting a position of the user in front of the display surface 110S and a distance from the user. In some embodiments, the distance detector 120 may use ultrasound, infrared, or/and other methods to detect the distance. In some embodiments, the distance detector 120 can be an infrared detector 120, which can be used with an infrared emitter (e.g., an infrared light-emitting diode). Specifically, when detecting the distance, the infrared emitter can emit infrared rays, and the infrared rays hit an object and are reflected back and received by the infrared receiver. The distance is calculated based on the time from emitting the infrared rays to receiving the infrared rays and the propagation speed of the infrared rays.

In some embodiments, the processor 130 includes a determining unit 132 and a resolution-adjusting unit 134. The determining unit 132 can be used to receive the signal from the distance detector 120 and determine a display mode. The resolution-adjusting unit 134 can receive the display mode determined by the determining unit 132, adjust the image signal, and send the adjusted image signal to the display panel 100. In some embodiments, the processor 130 may be a computer, a digital signal processor, a microprocessor, and/or other processors. The determining unit 132 and the resolution-adjusting unit 134 may be located in the same processor 130 or in multiple different processors 130.

Figure 1C:
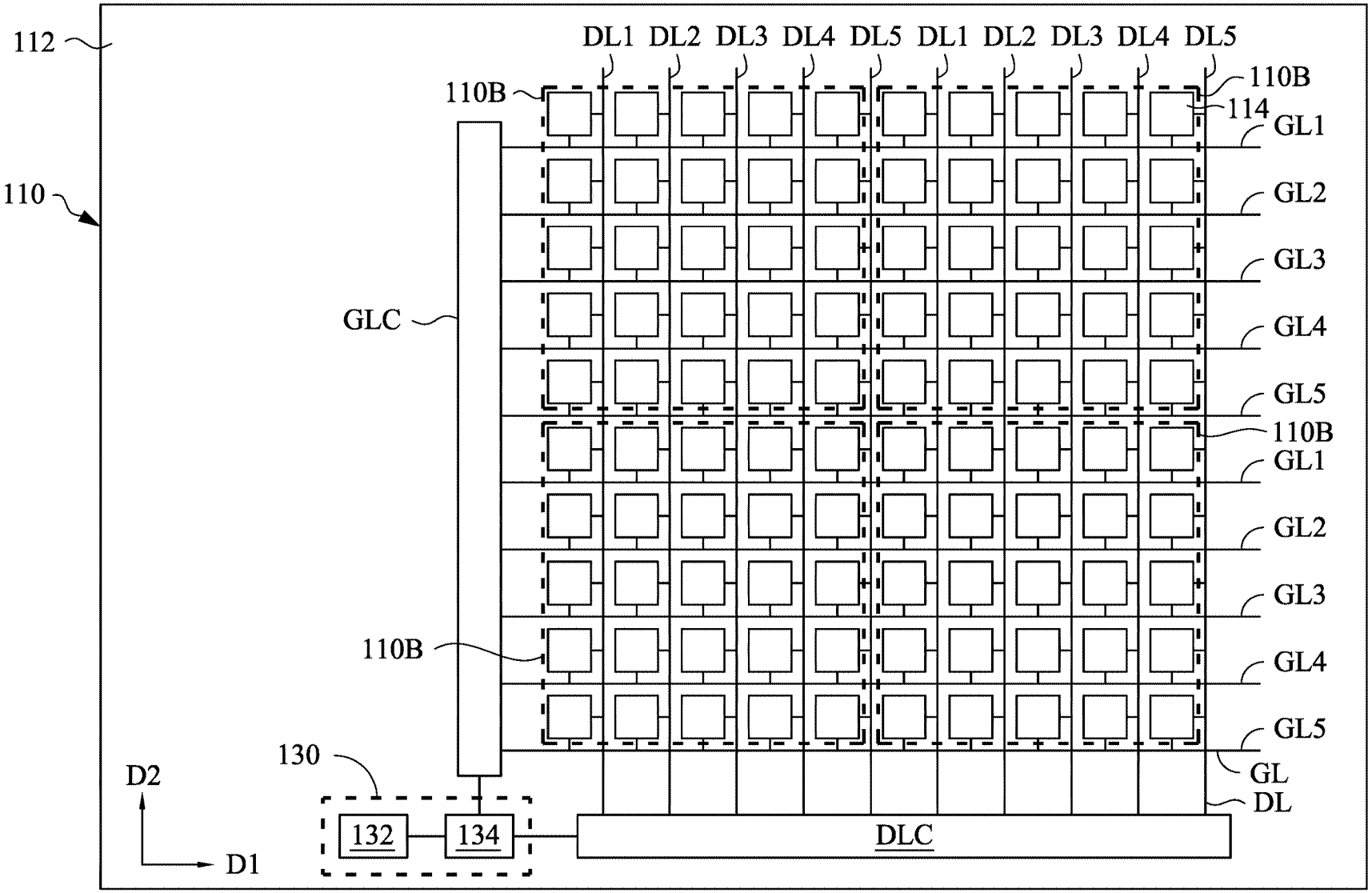
FIG. 1C is a schematic top view of a display panel according to some embodiments of the present invention.

FIG. 1C is a schematic top view of a display panel 110 according to some embodiments of the present invention. The display panel 110 includes a substrate 112, a plurality of data lines DL, a plurality of scan lines GL, and a plurality of pixels 114. Each of the pixels 114 is controlled by a data line DL and a scan line GL. In some embodiments, the scan line GL extends along the first direction D1, and the data line DL extends along the second direction D2, where the first direction D1 and the second direction D2 are intersected with each other. In some embodiments, the first direction D1 is perpendicular to the second direction D2. The display panel 110 may also include a data control circuit DLC and a scan control circuit GLC. The data control circuit DLC is used to provide data signals to the data line DL. The scan control circuit GLC is used to provide a scan signal to the scan line GL. In some embodiments, one or more of the data control circuit DLC, the scan control circuit GLC, the determining unit 132, and the resolution-adjusting unit 134 (refer to FIG. 1B) may be located in the same processor or different processors.

In some embodiments of the present invention, the display panel 110 may include a plurality of blocks 110B, and each of the blocks 110B includes a plurality of pixels 114. In some embodiments, the number of pixels 114 in each block 110B is the same, and the arrangement of the pixels 114 in each block 110B is the same. In this embodiment, each block 110B is in a shape of a square, and the pixels 114 therein are arranged in a square array. In this embodiment, the blocks 110B are aligned horizontally (along the first direction D1) and vertically (along the second direction D2) with each other. Of course, the scope of the present invention should not be limited thereto. In some other embodiments, the shape and arrangement of the blocks 110B and the arrangement of the pixels 114 in the block 110B may have other configurations. In some embodiments of the present invention, the number of the blocks 110B in a display panel 110 is at least four. In the present embodiments, the total number of pixels 114 in all the blocks 110B is equal to the total number of pixels 114 in the display area of the display panel 110 (for example, the area corresponding to the display surface 110S in FIG. 1). In some other embodiments, the total number of pixels 114 in all the blocks 110B may be smaller than the total number of pixels 114 in the display area of the display panel 110 (for example, the area corresponding to the display surface 110S in FIG. 1).

For ease of description, herein, the data lines DL may be labeled as data lines DL1 to DL5, and the scan lines GL may be labeled as scan lines GL1 to GL5. Each of the pixels 114 in each block 110B is controlled by one of the data lines DL1 to DL5 and one of the scan lines GL1 to GL5.

Figure 1D:
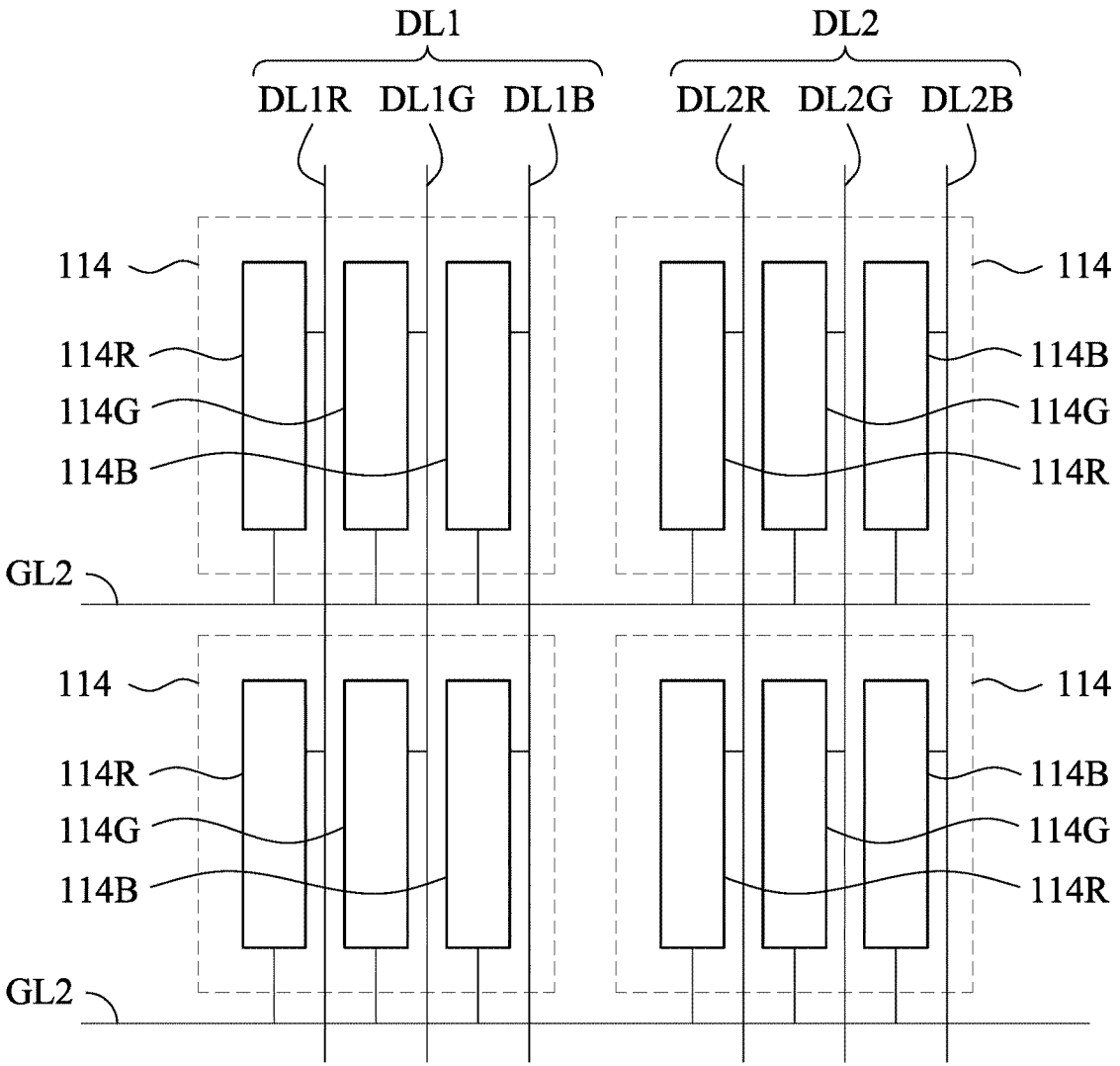
FIG. 1D is a schematic top view of a portion of the display panel of FIG. 1C.

FIG. 1D is a schematic top view of a portion of the display panel 110 of FIG. 1C. Each pixel 114 may include plural sub-pixels, which may be adjacent to each other. For example, each pixel 114 may include a red sub-pixel 114R, a green sub-pixel 114G, and a blue sub-pixel 114B. In one example, the plural sub-pixels (sub-pixels 114R, 114G, 114B) in each pixel 114 may respectively correspond to different colors filters (e.g., red, green, and blue filters) in a color filter film. In another example, the plural sub-pixels (sub-pixels 114G, 114B, 114R) in each pixel 114 may respectively correspond to LED units of different colors (e.g., red, green, and blue LED units). It should be understood that the shapes and numbers of the sub-pixels shown in the figure are merely illustrative, and are not intended to specifically limit the scope of the present invention. In addition, in the embodiment where each pixel 114 includes multiple sub-pixels, each of the data lines DL1 to DL5 (referring to FIG. 1C) may be a data line group, which includes plural data lines respectively connected to the sub-pixels 114R, 114G, and 114B in each pixel 114. For example, the data line DL1 includes a data lines DL1R, DL1G, and DL1B respectively connected to the sub-pixels 114R, 114G, 114B, and the data line DL2 includes data lines DL2R, DL2G, and DL2B respectively connected to the sub-pixels 114R, 114G, 114B. In this way, the sub-pixels 114G, 114B, and 114R in each pixel 114 can be independently controlled by the data lines.

Figure 2:
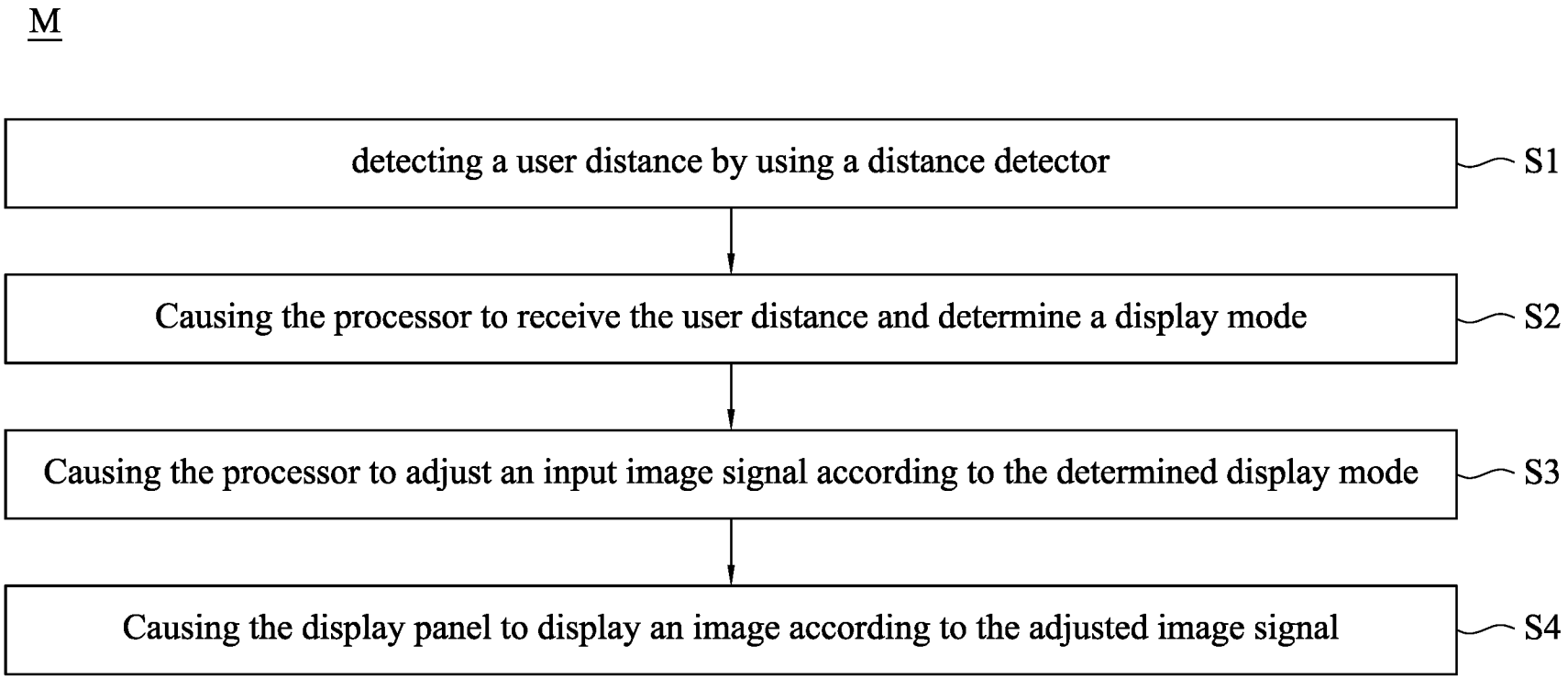
FIG. 2 is a flow chart of a method of using a display device according to some embodiments of the present invention.

FIG. 2 is a flow chart of a method M of using a display device 100 according to some embodiments of the present invention. Method M includes steps S1 to S4. It should be understood that other steps can be implemented before, during, or after steps S1 to S4. In other embodiments of method M, some of the steps may be replaced or omitted.

Reference is made to FIGS. 1A, 1B and FIG. 2. At step S1, the distance detector 120 is first used to detect a user distance L1. In some embodiments, the distance detector 120 detects an oblique distance or a vertical distance from a body part of the user relative to a suitable position of the display device 100, which is regarded as the user distance L1. The detected body part of the user can be any position of the head or face, such as eyes HE, nose, head, forehead or chin. Alternatively, the detected body part of the user may be other body parts, not limited to the head or face. The aforementioned suitable position of the display device 100 may be any position of the display panel 110 (e.g., any position of the display surface 110S), or any position other than the display panel 110 (e.g., the position of the distance detector 120). In some other embodiments, referring to FIG. 8, the user distance L1 may be referred to as the distance from the user's body part (such as the eyes HE or the head) to a center of the display surface 110S. As shown in FIG. 1B, the distance detector 120 send the signal LSL carrying the information about the user distance L1 to the determining unit 132 of the processor 130.

Reference is made to FIGS. 1A, 1B and FIG. 2. At step S2, the determining unit 132 of the processor 130 (or referred to as a comparison unit) receives the signal LSL carrying the information about the user distance L1, and determines a display mode according to the user distance L1. For example, the determining unit 132 may compare the user distance L1 with plural distance ranges of various levels, and determine a display mode based on the comparison result. Herein, the user distance L1 is illustrated in distance ranges of five levels, corresponding to five display modes, and the resolution of each display mode is different. In one embodiment, when the display device 100 is used in a mobile phone device, these distance ranges may respectively be greater than 100 centimeters (cm), from 70 cm to 100 cm, from 50 cm to 70 cm, from 30 cm to 50 cm, and from 0 cm to 30 cm. In another embodiment, when the display device 100 is used in a television device, these distance ranges may respectively be greater than 500 cm, from 400 cm to 500 cm, from 300 cm to 400 cm, from 200 cm to 300 cm, and from 0 cm to 200 cm.

In some embodiments, before or after the distance L1 is detected, the user can give a command 11 via the input device 140, to decide to perform an automatically-changing resolution mode or a fixed resolution mode. If the automatic resolution change mode is selected, steps S2-S4 will be performed. If the fixed resolution mode is selected, steps S2-S4 will not be performed. The input device 140 may be a device that can operate with the display panel 110 and configured for inputting instructions. For example, the input device 140 may be a touch panel mounted on the display panel 110, an infrared remote control, or the like.

When the user selects the automatically-changing resolution mode, the determining unit 132 sends a signal DSL carrying the information about the determined display mode to the resolution-adjusting unit 134 of the processor 130. During the operation of the display device 100, an image signal ISL1 can be provided to the processor 130.

Then, reference is made to FIGS. 1A to 1C and FIG. 2. At step S3, the resolution-adjusting unit 134 of the processor 130 receives the signal DSL, and according to the determination result (the determined display mode) of step S3, the resolution-adjusting unit 134 can adjust the input image signal ISL1, which becomes an input image signal ISL2 after the adjustment. At the following step S4, the display panel 110 displays an image with a corresponding resolution according to the input image signal ISL2 after the adjustment. Details are shown in FIGS. 3A to 3E below.

Figure 3A:
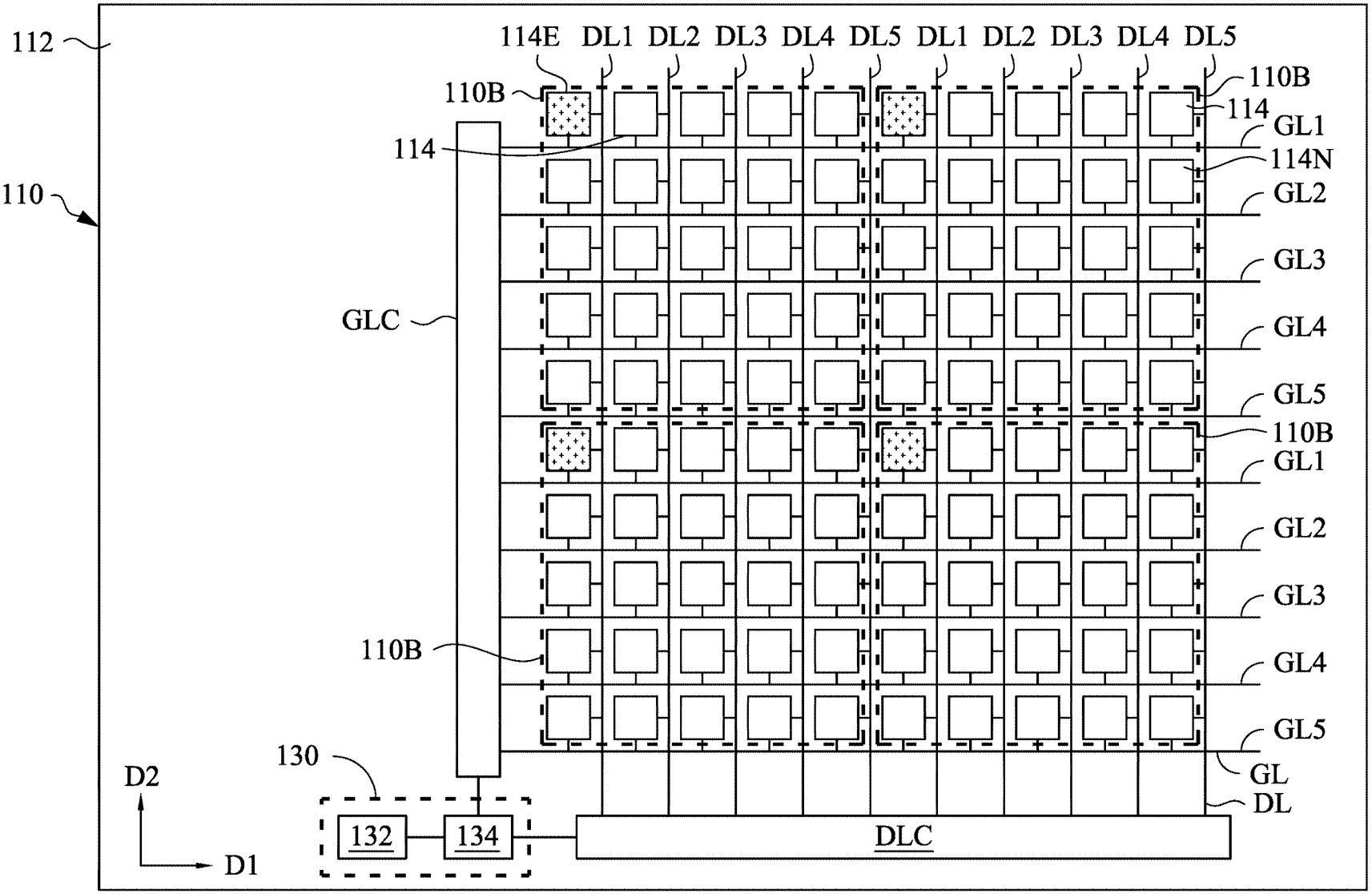
FIGS. 3A to 3E are schematic top views of using a display panel according to some embodiments of the present invention.

FIGS. 3A to 3E are schematic top views of using a display panel 110 according to some embodiments of the present invention. Reference is made to FIGS. 2 and 3A. When the user distance L1 (referring to FIG. 1A) is in the first distance range, at step S2, the determining unit 132 (referring to FIG. 1B) can determine that it is a first display mode. At step S3, the resolution-adjusting unit 134 (referring to FIG. 1B) adjusts the image signal according to the first display mode. Thereafter, at step S4, the display panel 110 receives the adjusted image signal and displays an image. The display panel displays the image by a first proportion of the pixels 114 in each block 110B. In this example, each block 110B contains twenty-five pixels 114. One pixel 114 (e.g., the pixel 114E) in each block 110B is used to display the image, and other pixels 114 (e.g., pixels 114N) are not used to display the image, and the first proportion can be 4%.

Herein, the description that "other pixels 114 (e.g., pixels 114N) are not used to display the image" means that these other pixels 114N are not driven. In the case of an organic light emitting diode display panel, the pixels 114N that are not driven will show a black picture, and in the case of a liquid crystal display panel, the pixels 114N that are not driven will show a black picture or a white picture. For the ease of description, in the figures, the pixels displaying the image are filled with patterns and are marked as effective pixels 114E; the pixels not displaying the image are shown as blanks and marked as null pixels 114N. The first distance range may, for example, be a range greater than 100 cm.

Specifically, in FIG. 3A, the data control circuit DLC only provides the signal to the data line DL1, and does not provide the signal to the data line DL2 to DL5; the scan control circuit GLC only provides the signal to the scan line GL1, but does not provide the signal to the scan line GL2 To GL5. In this way, compared to a higher resolution display (referring to FIG. 3B to FIG. 3E), the power consumption of the higher resolution display can be reduced. In addition, by reducing the number of scan lines that should be provided with signals, the scan control circuit GLC can quickly scan all scan lines GL1, thereby increasing the frame rate (a number of display frames per second)(or the refresh rate), which in turn will improve the user's comfort of viewing.

Figure 3B:
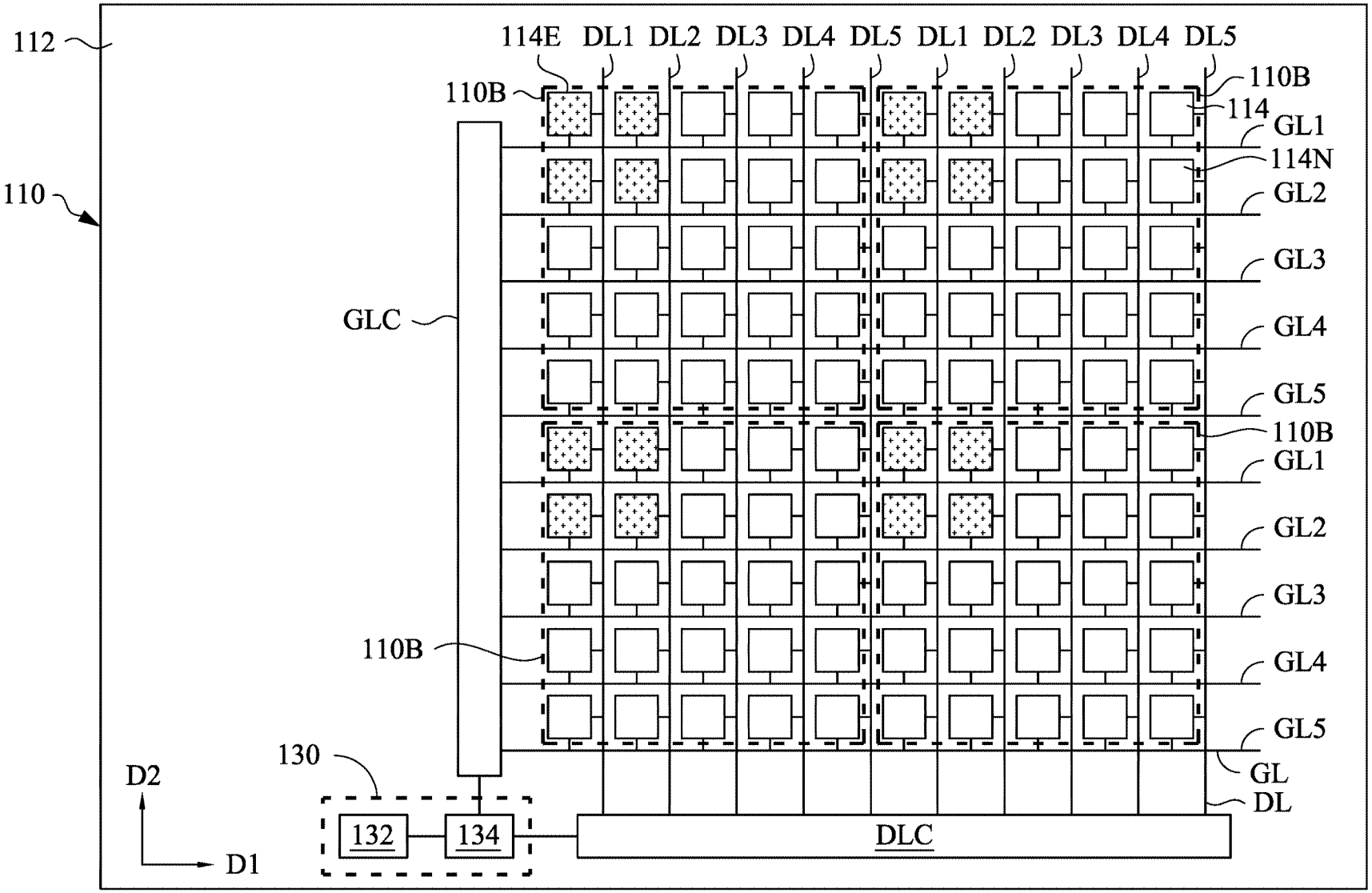

Referring to FIG. 3B, when the user distance L1 (referring to FIG. 1A) is in the second distance range, at step S2, the determining unit 132 (referring to FIG. 1B) may determine that it is a second display mode. At step S3, the resolution-adjusting unit 134 (referring to FIG. 1B) adjusts the image signal according to the second display mode. Thereafter, at step S4, the display panel 110 receives the adjusted image signal and displays an image. The display panel can display the image by a second proportion of the pixels 114 in each block 110B. In this example, four pixels 114E of the twenty-five pixels 114 in each block 110B are used to display the image, other pixels 114N are not used to display the image, and the second proportion may be 16%. Herein, the second distance range may be referred to as a range from 70 cm to 100 cm.

Specifically, in FIG. 3B, the data control circuit DLC only provides signals to data lines DL1 and DL2, and does not provide signals to data lines DL3 to DL5; the scan control circuit GLC only provides signals to scan lines GL1 and GL2, and does not provide signals to scan lines GL3 to GL5. In this way, compared with a higher resolution display (referring to FIGS. 3C to 3E), the power consumption of the higher resolution display can be reduced. In addition, by reducing the number of scan lines that should be provided with signals, the scan control circuit GLC can quickly scan all the scan lines GL1 and GL2, thereby increasing the frame rate, which in turn will improve the user's comfort of viewing.

Figure 3C:
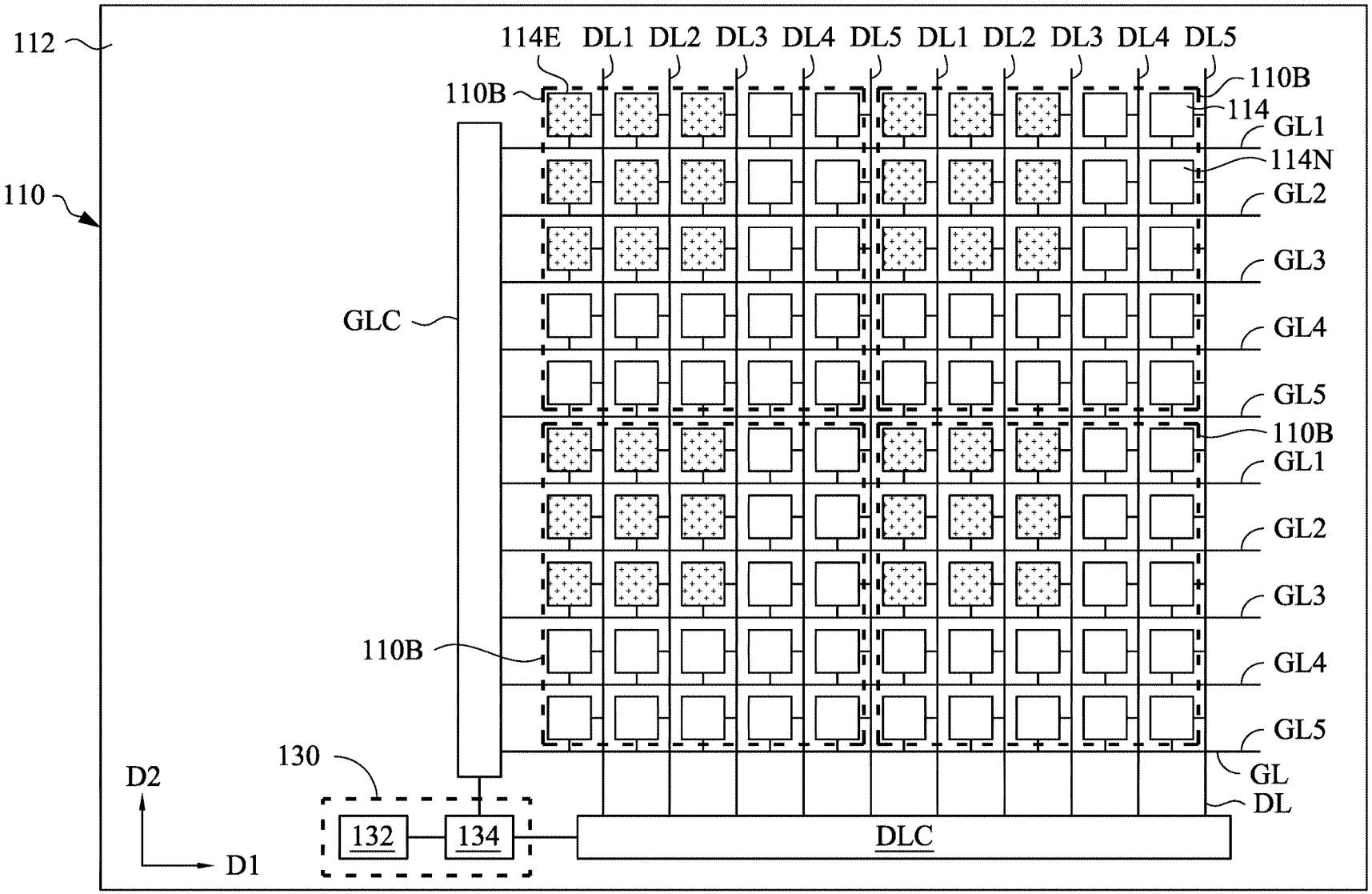

Referring to FIG. 3C, when the user distance L1 (referring to FIG. 1A) is in the third distance range, at step S2, the determining unit 132 (referring to FIG. 1B) may determine that it is a third display mode. At step S3, the resolution-adjusting unit 134 (referring to FIG. 1B) adjusts the image signal according to the third display mode. Thereafter, at step S4, the display panel 110 receives the adjusted image signal and displays an image. The display panel 110 can display the image by a third proportion of the pixels 114 in each block 110B. In this example, nine pixels 114E of the twenty-five pixels 114 in each block 110B are used to display the image, other pixels 114N are not used to display the image, and the third proportion may be 36%. Herein, the third distance range may be referred to as a range from 50 cm to 70 cm.

Specifically, in FIG. 3C, the data control circuit DLC only provides signals to the data lines DL1 to DL3, and does not provide signals to the data lines DL4 and DL5; the scan control circuit GLC only provides signals to the scan lines GL1 to GL3, but does not provide signals to the scan line GL4 and GL5. In this way, compared with a higher resolution display (refer to FIG. 3D and FIG. 3E), the power consumption of the higher resolution display can be reduced. In addition, by reducing the number of scan lines that should be provided with signals, the scan control circuit GLC can quickly scan all the scan lines GL1 to GL3, thereby increasing the frame rate, which in turn will improve the user's comfort of viewing.

Figure 3D:
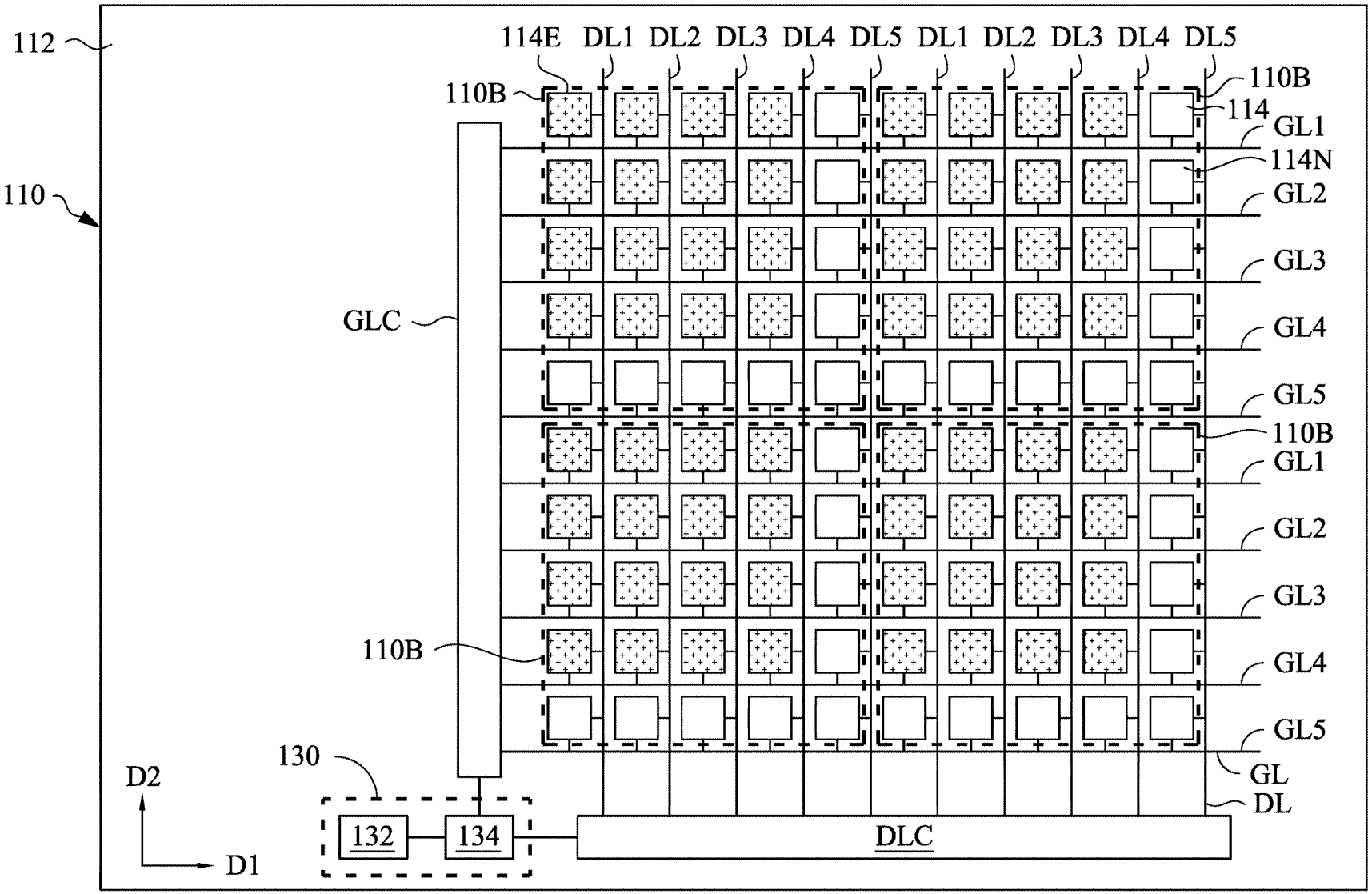

Referring to FIG. 3D, when the user distance L1 (referring to FIG. 1A) is in the fourth distance range, at step S2, the determining unit 132 (referring to FIG. 1B) may determine that it is a fourth display mode. At step S3, the resolution-adjusting unit 134 (referring to FIG. 1B) adjusts the image signal according to the fourth display mode. Thereafter, at step S4, the display panel 110 receives the adjusted image signal and displays an image. The display panel 110 can display the image by a fourth proportion of the pixels 114 in each block 110B. In this example, sixteen pixels 114E of the twenty-five pixels 114 in each block 110B are used to display the image, other pixels 114N are not used to display the image, and the fourth proportion may be 64%. Herein, the fourth distance range may be referred to as a range from 30 cm to 50 cm.

Specifically, in FIG. 3D, the data control circuit DLC only provides signals to the data lines DL1 to DL4, but does not provide signals to the data line DL5; the scan control circuit GLC only provides signals to the scan lines GL1 to GL4 signals, but does not provide signals to the scan line GL5. In this way, compared to a higher resolution display (referring to FIG. 3E), the power consumption can be reduced. In addition, by reducing the number of scan lines that should be provided with signals, the scan control circuit GLC can quickly scan all the scan lines GL1 to GL4, thereby increasing the frame rate, which in turn will improve the user's comfort of viewing. In addition, compared to a lower resolution display (referring to FIG. 3A to 3C), this fourth display mode can improve the screen resolution.

Figure 3E:
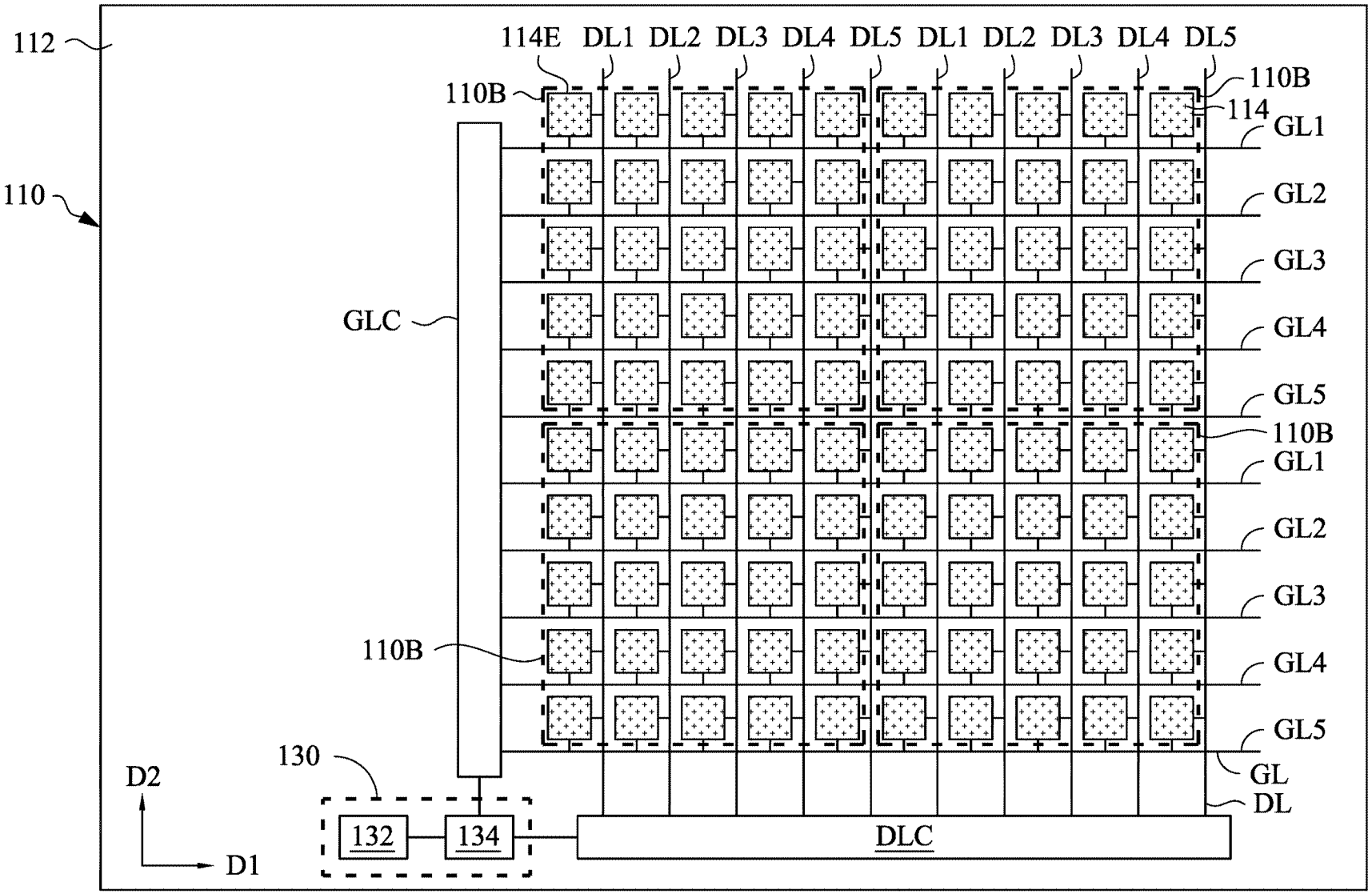

Referring to FIG. 3E, when the user distance L1 (referring to FIG. 1A) is in the fifth distance range, at step S2, the determining unit 132 ((referring to FIG. 1B) may determine that it is a fifth display mode. At step S3, the resolution-adjusting unit 134 (referring to FIG. 1B) adjusts the image signal according to the fifth display mode. Thereafter, at step S4, the display panel 110 receives the adjusted image signal and displays an image. The display panel can display the image by a fifth proportion of the pixels 114 in each block 110B. In this example, when each block 110B includes twenty-five pixels 114, the image is displayed by twenty-five pixels 114E in each block 110B, and the fifth proportion may be 100%. Herein, each block 110B may not include null pixels 114N (referring to FIGS. 3A to 3D). Herein, the fifth distance range may be referred to as a range from 0 cm to 30 cm.

Specifically, in FIG. 3E, the data control circuit DLC provides signals to the data lines DL1 to DL5; and the scan control circuit GLC provides signals to the scan lines GL1 to GL5. In this way, compared with a lower resolution display (referring to FIGS. 3A to 3D), the screen resolution can be improved.

In FIGS. 3A to 3E, the first to fifth distance ranges decrease sequentially, and the first to fifth proportions increase sequentially. In other words, as the user distance L1 decreases gradually, for each block 110B, the number of the effective pixels 114E increases gradually, and the number of the null pixels 114N decreases gradually.

In the display modes of FIGS. 3A to 3E, the entirety of the effective pixels 114E still retains the shape of the block 110B, such as a square. In other words, in each of display modes, the overall shape of each of the proportions of the pixels 114 (i. e., the effective pixels 114E) in each block 110B is the same as the shape of the block 110B. In other embodiments, the overall shapes of the effective pixels 114E in the display modes of FIGS. 3A to 3E may be different from the shape of the block 110B (e.g., a square). For example, the overall shapes of the effective pixels 114E in the display modes of FIGS. 3A to 3E may be parallelogram, diamond, etc. In some other embodiments, among the display modes of FIGS. 3A to 3E, the overall shapes of the effective pixels 114E may be different from each other. The exemplary five number of the display modes is only for illustration purpose, and is not used to limit the scope of the present invention. In other embodiments, there may be more than five or less than five display modes.

Figure 4A:
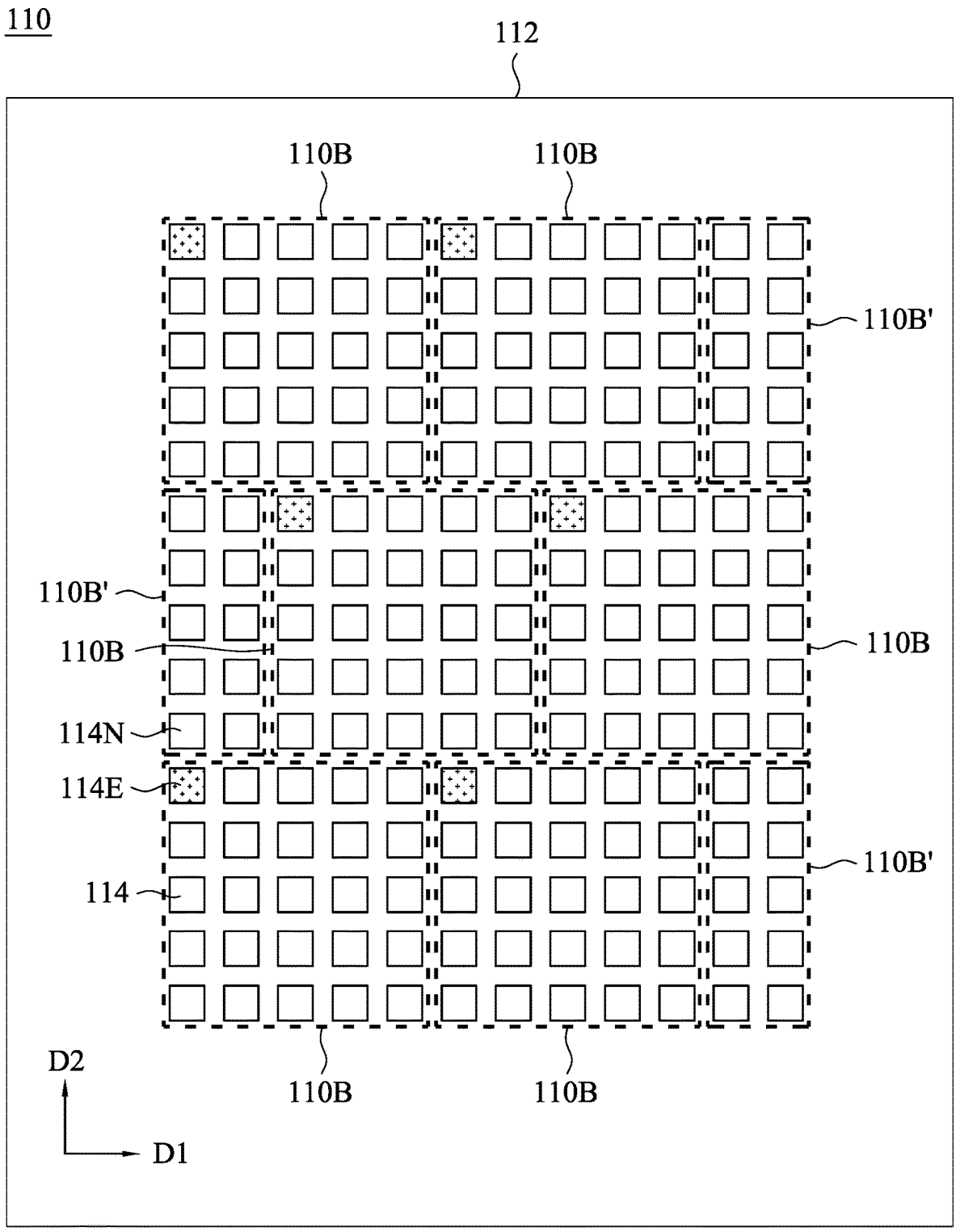
FIGS. 4A to 4C are schematic top views of using a display panel according to some embodiments of the present invention.
Figure 4B:
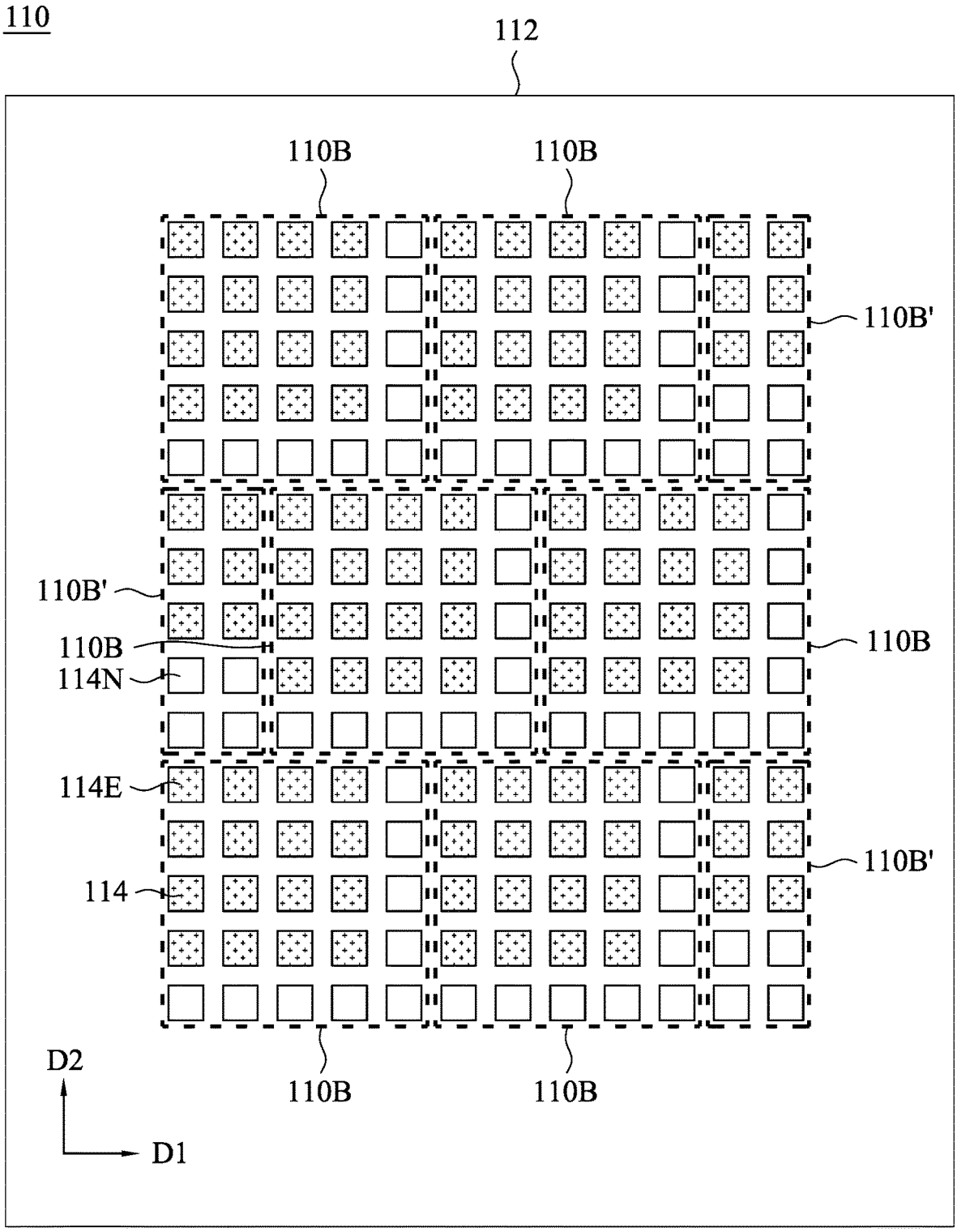
Figure 4C:
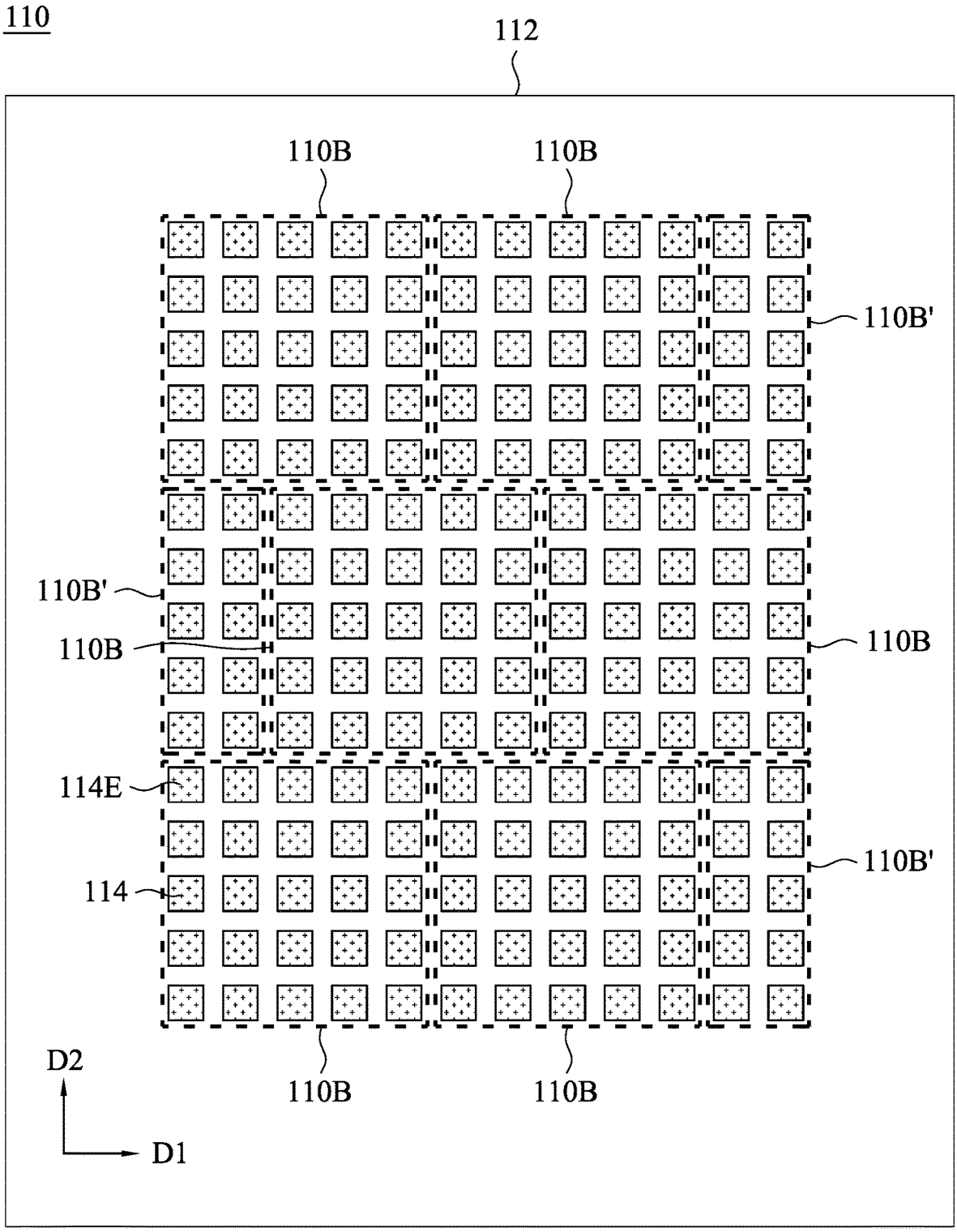

FIGS. 4A to 4C are schematic top views of using a display panel 110 according to some embodiments. The present embodiments are similar to FIGS. 3A to 3E, except that: in the present embodiments, referring to FIG. 4A, the blocks 110B are aligned horizontally (along the first direction D1) with each other, but not vertically aligned with each other. For example, in the second direction D2, adjacent blocks 110B are misaligned with each other or arranged in a staggered manner. For example, a part of the pixels 114 in the topmost row of each block 110B are at least partially not aligned with the pixels 114 in the bottommost row of a top neighboring block 110B. For example, a top edge of each block 110B adjoins bottom edges of two blocks 110B. In other embodiments, the blocks 110B can be vertically aligned with each other but staggered horizontally. Alternatively, in other embodiments, the blocks 110B may be staggered vertically and horizontally.

In the present embodiments, a total number of the pixels 114 in all the blocks 110B may be smaller than a total number of the pixels 114 in the display area of the display panel 110. For example, at the edges of the display panel 110 or around the block 110B, there are pixels 114 in such a deformed distribution that it is difficult to use these pixels 114 to form a complete block 110B. For example, these deformedly distributed pixels form a block 110B, in which a size of the block 110B' is smaller than a size of the block 110B, and the number of pixels 114 of the block 110B' is less than the number of pixels 114 of the block 110B. When the user selects the fixed resolution mode, all the pixels 114 in the block 110B and the block 110B' may be used to display the image. When the user selects the automatically-changing resolution mode, which causes the pixels 114 in the block 110B to display the image by a proportion based on the distance, the pixels 114 in the block 110B' can also display the image by a proportion based on the distance. For example, in FIGS. 4A to 4C, the block 110B' includes the effective pixels 114E and the null pixels 114N. Alternatively, in other embodiments, when the user selects the automatically-changing resolution mode, which causes the pixels 114 in the block 110B to display the image by a proportion based on the distance, the pixels 114 in the block 110B' may not display the image. For example, the block 110B' will show a black or white picture.

Referring to FIGS. 4A to 4C, when the user distance L1 (referring to FIG. 1A) is in the first, second, or third distance range, the determining unit 132 can determine that it is the first, second, or third display mode, respectively. The resolution-adjusting unit 134 adjusts the image signal according to the determined display mode. Thereafter, the display panel 110 receives the adjusted image signal and displays an image. For example, the display panels 110 of FIGS. 4A to 4C respectively display images by first to third proportions of the pixels 114 in each block 110B. Similarly, in FIGS. 4A to 4C, in each block 110B', the blocks 110B' can also display images by different proportions of the pixels 114 (e.g., approximately first to third proportions of the pixels 114), which may be similar to that of the pixels 114 in the block 110B in the some embodiments.

In some embodiments, as the user distance L1 decreases gradually, the proportion increases gradually from the first to third proportions, and in each block 110B, the number of the effective pixels 114E increases gradually, and the number of the null pixels 114N decreases gradually. The exemplary three number of the display modes is only for illustration purpose, and is not used to limit the scope of the present invention. Other details of the present embodiments are almost the same as those described in the embodiments of FIGS. 3A to 3E, and thereto not repeated herein.

Figure 5:
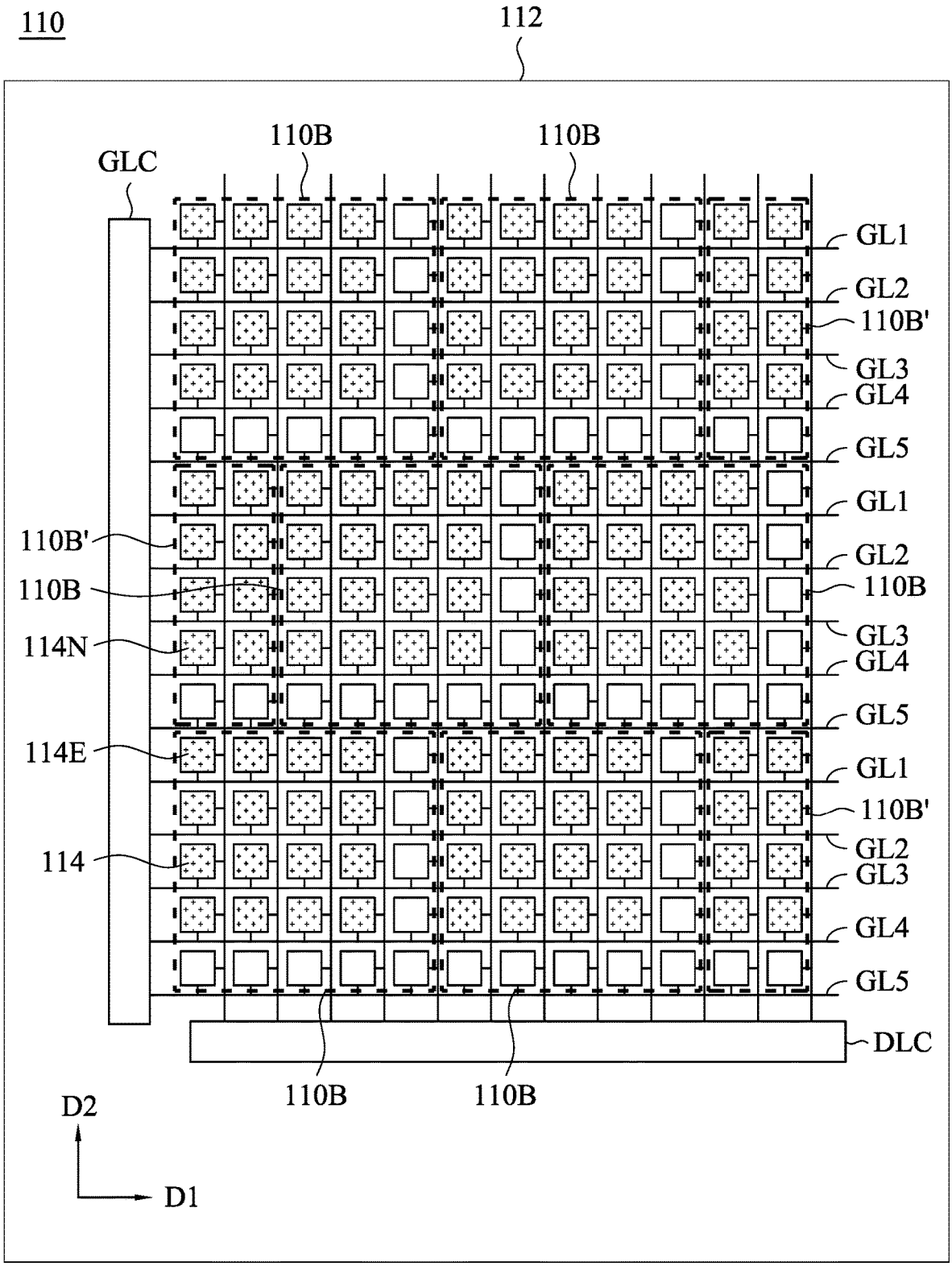
FIG. 5 is a schematic top view of using a display panel according to some embodiments of the present invention.

FIG. 5 is a schematic top view of using a display panel according to some embodiments of the present invention. This embodiment is similar to FIGS. 4A to 4C, except that: in this embodiment, the blocks 110B' can display image by using the effective pixels 114E having a same arrangement as a part of the effective pixels 114E in the block 110B. For example, in the second display mode (as the display mode of FIG. 4B), the blocks 110B' has eight effective pixels 114E, and a bottommost row of the effective pixels 114E in the block 110B' is the aligned with a bottommost row of the effective pixels 114E in the block 110B. Through the design, the effective pixels 114E in blocks 110B and 110B' may be controlled by the same numbers of the scan line GL (e.g., the scan line GL1-GL4 for the second display mode), thereby simplifying the control of the operation of the blocks 110B and 110B'. In the present embodiments, the blocks 110B' may display image without considering the proportion of the pixels 114. Therefore, in various display modes, the proportions of the pixels 114 to display image in the block 110' may be different from (e.g., higher or lower than) that of the pixels 114 in the block 110B. Other details of the present embodiments are the similar to that of FIGS. 4A-4C, and therefore not repeated herein.

Figure 6A:
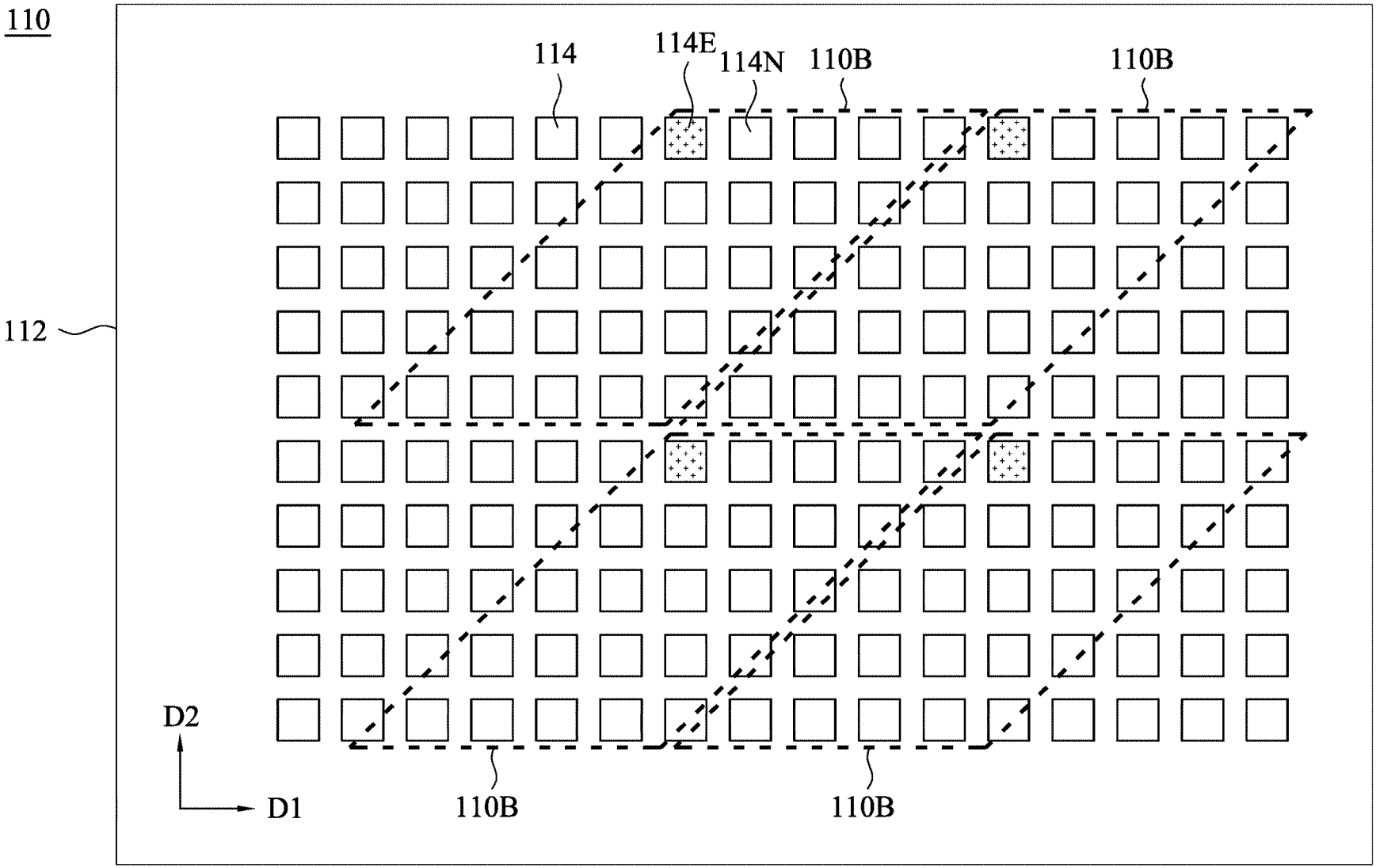
FIGS. 6A to 6C are schematic top views of using a display panel according to some embodiments of the present invention.
Figure 6B:
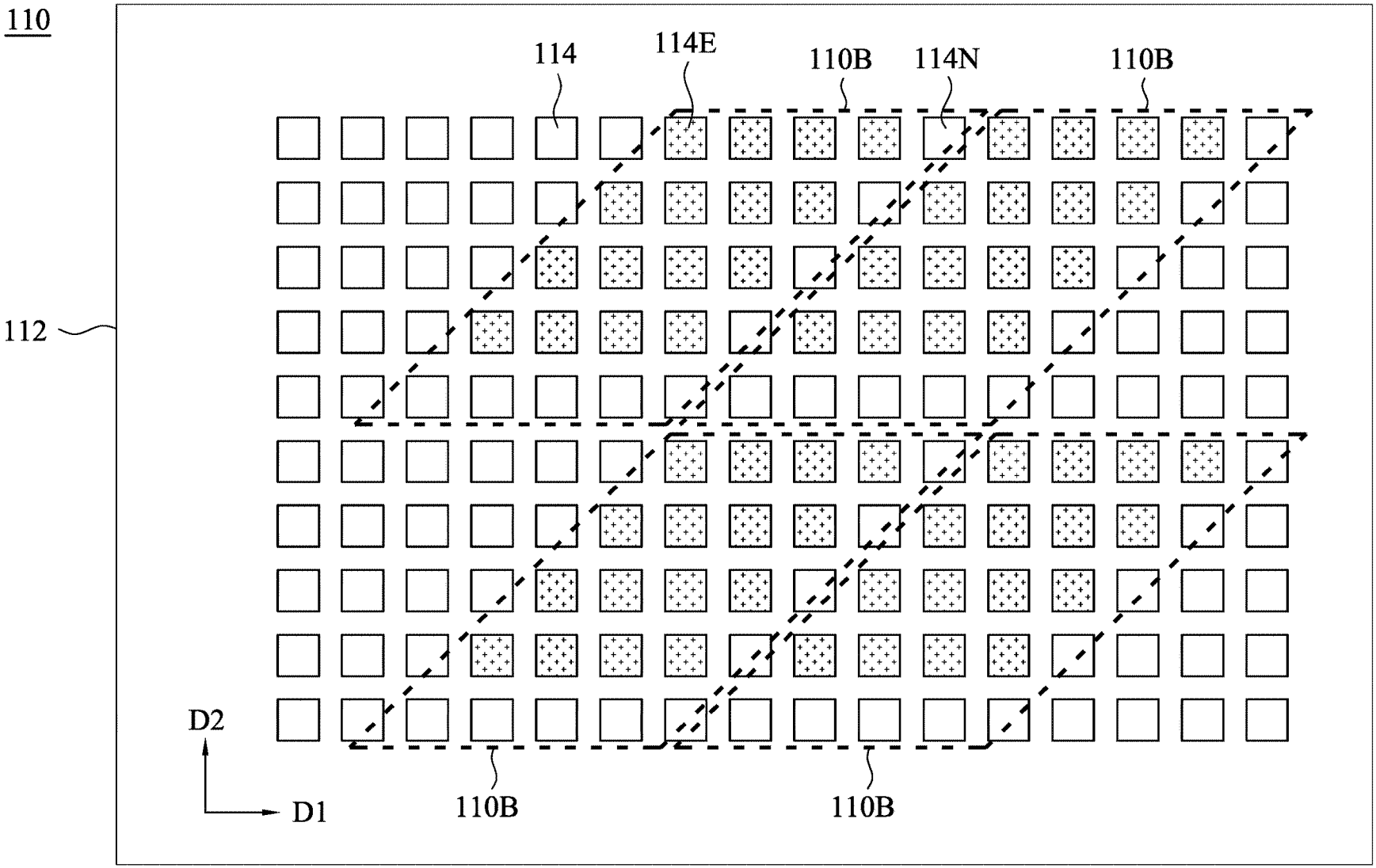
Figure 6C:
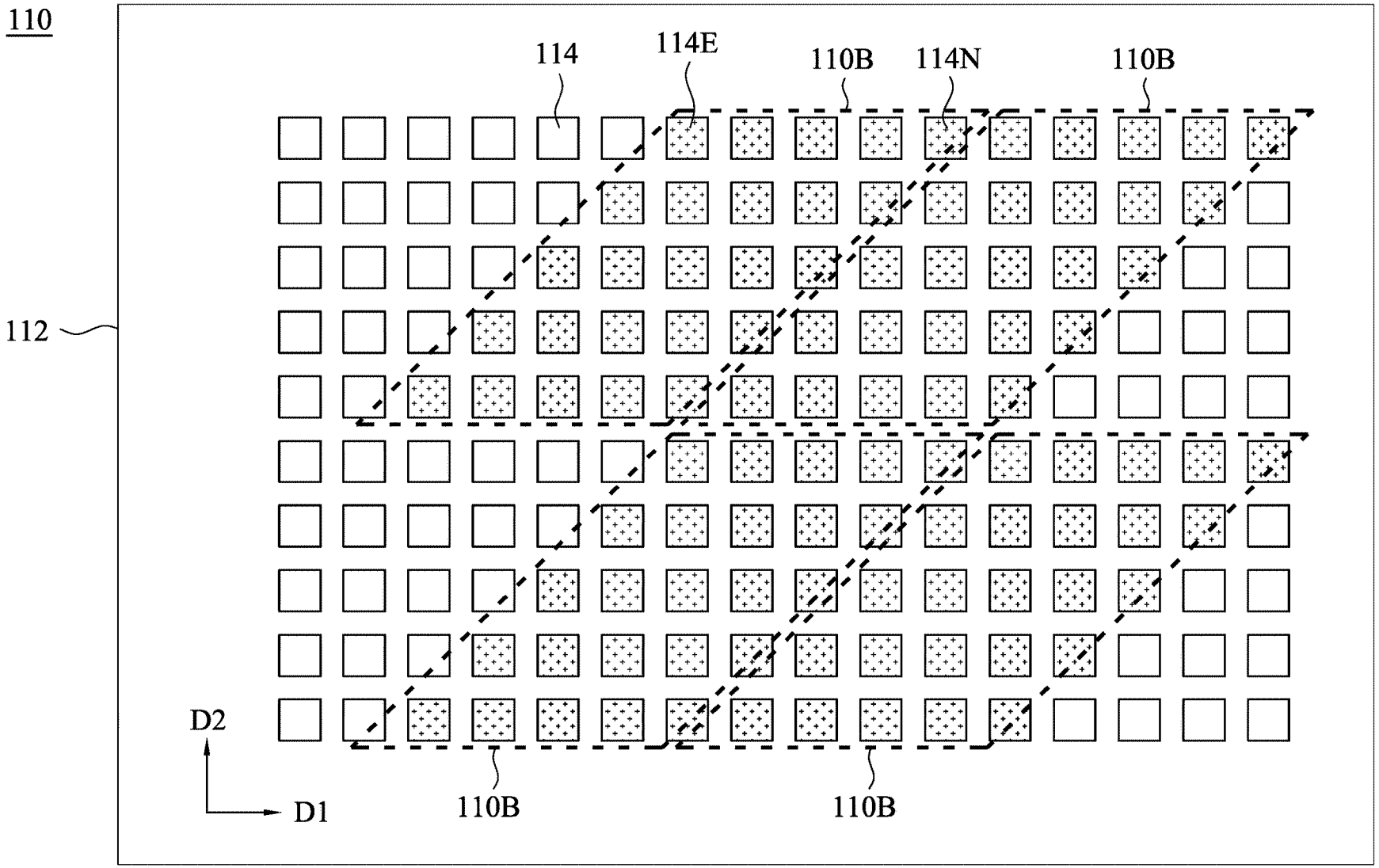

FIGS. 6A to 6C are schematic top views of using the display panel 110 according to some embodiments. This embodiment is similar to FIGS. 3A to 3E, except that: in this embodiment, the shape of the block 110B is a parallelogram. In this embodiment, the blocks 110B are aligned horizontally (along the first direction D1) and aligned longitudinally (along the second direction D2) with each other. 5A to 5C, when the user distance L1 falls within the first, second, or third distance range, it is determined as the first, second, or third display mode, respectively, and the display panel 110 is in the first, second, or third display mode of each block 110B. The pixels 114 of one to the third ratio present images. In this example, as the user distance L1 gradually decreases, the first to third ratios gradually increase, the number of the effective pixels 114E in each block 110B gradually increases, and the number of the null pixels 114N gradually decreases. The exemplary three number of the display modes is only for illustration purpose, and is not used to limit the scope of the present invention.

In the display modes of FIGS. 6A to 6C, the entirety of the effective pixels 114E still retains the shape of the block 110B, such as a parallelogram. In other embodiments, in the display modes of FIGS. 6A to 6C, the overall shapes of the effective pixel 114E may be different from the shape of the block 110B (e.g., a parallelogram herein). For example, the overall shapes of the effective pixels 114E in the display modes of FIGS. 6A to 6C may be a square, a diamond, etc. In some other embodiments, among the display modes of FIGS. 6A to 6C, the overall shapes of the effective pixel 114E may be different from each other. Other details of the present embodiments are almost the same as those described in the embodiments of FIGS. 3A to 3E, and thereto not repeated herein.

In other embodiments, the parallelogram blocks 110B may be aligned horizontally (along the first direction D1) with each other, but not aligned vertically (along the second direction D2) with each other. For example, in the second direction D2, adjacent blocks 110B are misaligned or staggered with each other. In other words, a part of the pixels 114 in the topmost row of each block 110B are at least partially not aligned with the pixels 114 in the bottommost row of a top neighboring block 110B. For example, a top edge of each block 110B adjoins bottom edges of two blocks 110B. In other embodiments, the blocks 110B can be vertically aligned with each other but staggered horizontally. Alternatively, in other embodiments, the blocks 110B may be staggered vertically and horizontally.

Figure 7A:
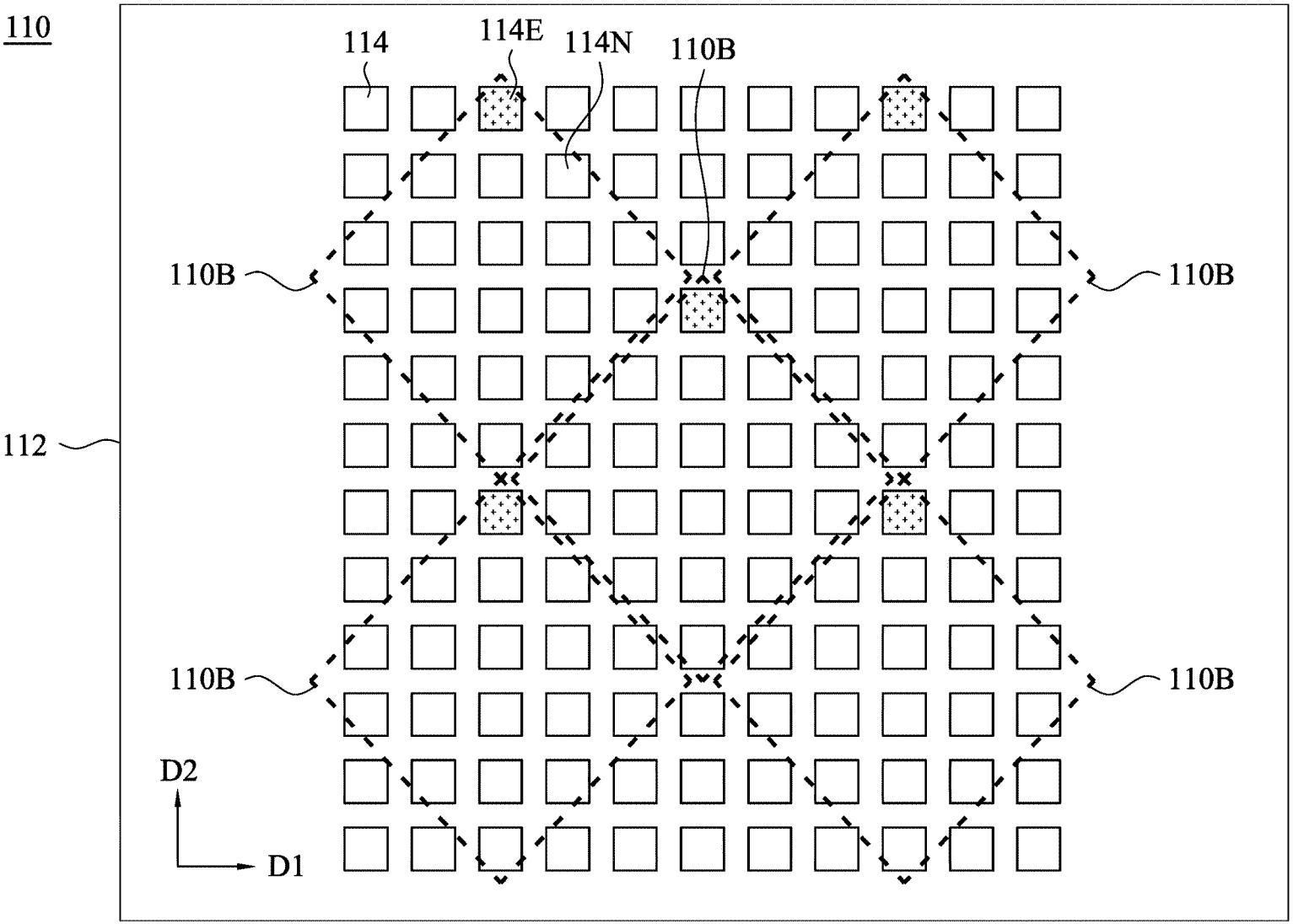
FIGS. 7A and 7B are schematic top views of using a display panel according to some embodiments of the present invention.
Figure 7B:
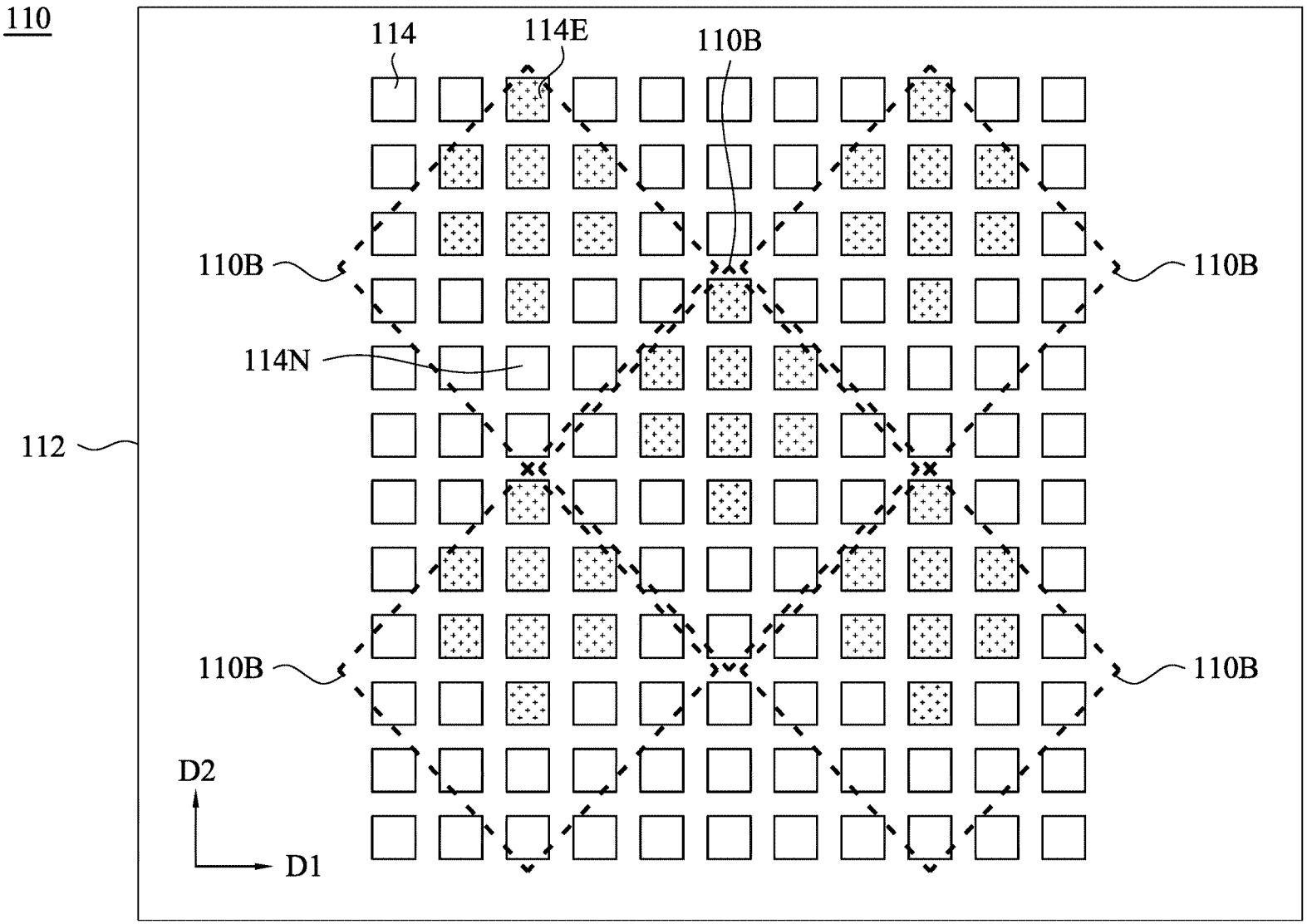

FIGS. 7A to 7B are schematic top views of using the display panel 110 according to some embodiments. The present embodiments are similar to FIGS. 3A to 3E, except that: in the present embodiments, the shape of the block 110B is a diamond. In this embodiment, the blocks 110B are aligned horizontally (along the first direction D1) and aligned vertically (along the second direction D2) with each other.

Referring to FIGS. 7A and 7B, when the user distance L1 is in the first or second distance range, the first or second display mode is determined, and the display panel 110 displays an image by a first proportion or a second proportion of pixels 114 in each block 110B. Although not shown, when the user distance L1 is in the third distance range, a third display mode is determined, and the display panel 110 displays an image with by a third proportion of the pixels 114 in each block 110B. In some embodiments, as the user distance L1 decreases gradually, the proportion increases gradually from the first proportion to third proportions, and in each block 110B, the number of the effective pixels 114E gradually increases, and the number of the null pixels 114N gradually decreases. The exemplary number of the display modes is only for illustration purpose, and is not used to limit the scope of the present invention. In these display modes, the entirety of the effective pixels 114E still retains the diamond shape of the block 110B. In other embodiments, in the display modes, the overall shapes of the effective pixels 114E may be different from the diamond shape of the block 110B. For example, the overall shapes of the effective pixels 114E may be a square, a parallelogram, or the like. In some other embodiments, among the display modes, the overall shapes of the effective pixels 114E may be different from each other. Other details of the present embodiments are almost the same as those described in the embodiments of FIGS. 3A to 3E, and thereto not repeated herein.

Figure 8:
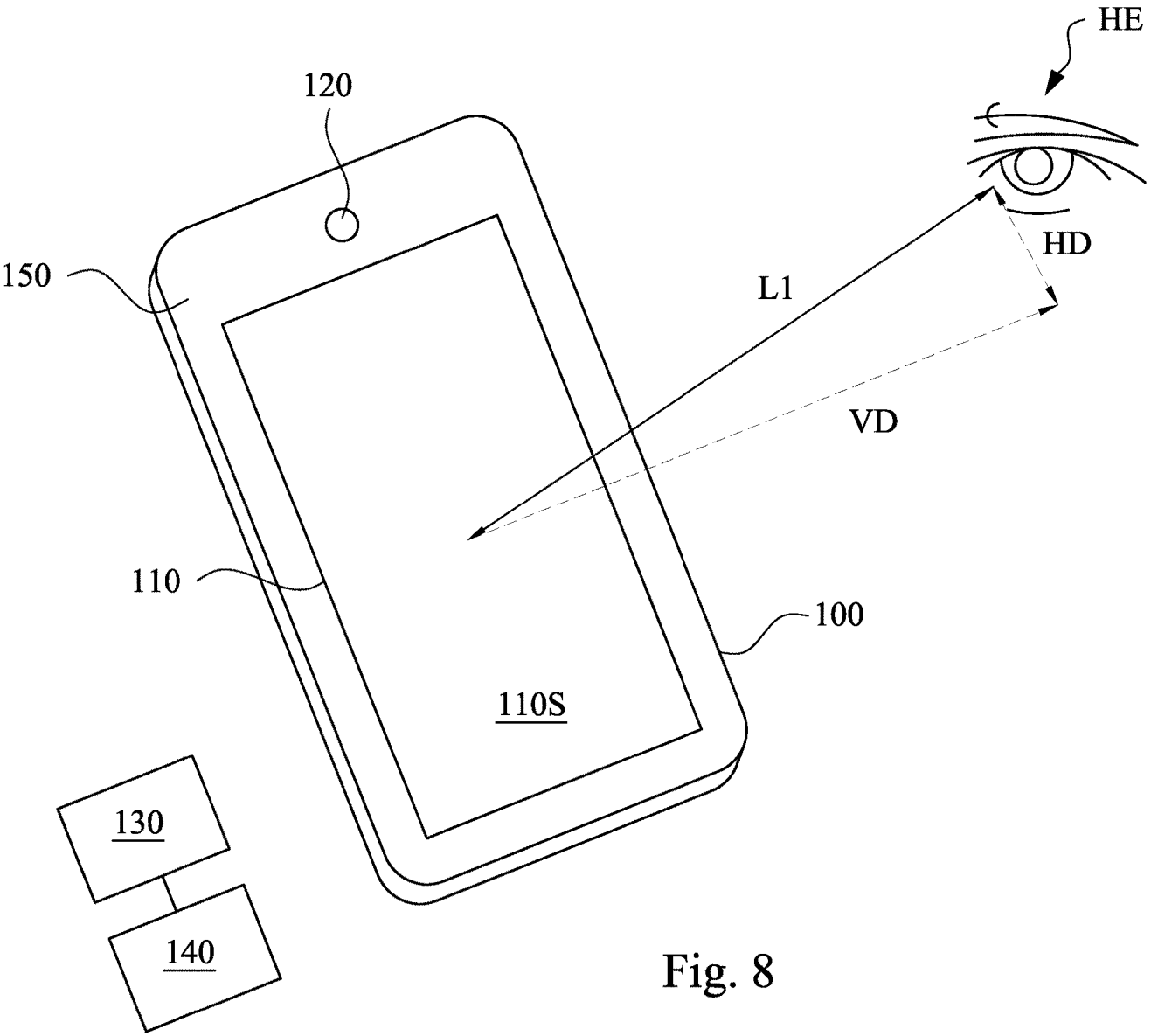
FIG. 8 is an application illustration of a display device according to some embodiments of the present invention.

FIG. 8 is an application illustration of a display device according to some embodiments of the present invention. As mentioned above, the user distance L1 may be referred to as the distance from the user's body part (e.g., the eyes HE or the head) to a center of the display surface 110S. Specifically, the distance detector 120 can detect the horizontal distance HD between the position of the user's body part (e.g., the eyes HE or the head) on a plane parallel to the display surface 110S and a center line normal to the display surface 110S. A square root of a sum of a square of the distance HD and a square of the vertical distance VD as mentioned previously can be used as the user distance L1.

In some embodiments of the present invention, the display mode is determined by identifying the distance between the human eye and the panel, and then the resolution and scan frequency of the display panel are controlled to achieve visual comfort while saving power. Users can also select an automatically-changing resolution mode or a fixed resolution mode according to their preferences, their distances from the display device, and their vision conditions.

The foregoing outlines features of several embodiments so that those skilled in the art may better understand the aspects of the present disclosure. Those skilled in the art should appreciate that they may readily use the present invention as a basis for designing or modifying other processes and structures. Those skilled in the art should also realize that such equivalent constructions do not depart from the spirit and scope of the present invention, and that they may make various changes, substitutions, and alterations herein without departing from the spirit and scope of the present invention.

What is claimed is:

1. A display method applicable to a display device, wherein the display device comprises a display panel, a distance detector, and a processor electrically connected with the display panel and the distance detector, the display panel comprises a plurality of blocks, each of the blocks comprises a plurality of pixels, and the display method comprises:

using the processor to adjust an image signal according to a user distance between a user and the display device detected by the distance detector; and sending the adjusted image signal to the display panel, thereby causing the display panel to display an image, wherein:

if the user distance is in a first distance range, the image is displayed by a plurality of first pixel groups, leaving a undriven portion of the pixels of each of the blocks, wherein each of the first pixel groups is a first proportion of the pixels of each of the blocks, and a pixel number of the first proportion of the pixels of each of the blocks is less than a pixel number of the undriven portion of the pixels of each of the blocks;

if the user distance is in a second distance range, the image is displayed by a plurality of second pixel groups, wherein each of the second pixel groups is a second proportion of the pixels of each of the blocks, wherein the second distance range is less than the first distance range, and the second proportion is greater than the first proportion; and if the user distance is in a third distance range, the image is displayed by a plurality of third pixel groups, wherein each of the third pixel groups is a third proportion of the pixels of each of the blocks, wherein the third distance range is less than the second distance range, the third proportion is greater than the second proportion, and the first to third pixel groups comprise a same shape.

2. The display method of claim 1, wherein the blocks have a same shape.

3. The display method of claim 1, wherein the first to third pixel groups comprise the same shape as a shape of the blocks.

4. The display method of claim 1, wherein the third proportion is 100%.

5. The display method of claim 1, wherein adjacent two of the blocks are aligned with each other along a first direction, and adjacent two of the blocks are aligned with each other along a second direction orthogonal to the first direction.

6. The display method of claim 1, wherein adjacent two of the blocks are aligned with each other along a first direction, and adjacent two of the blocks are misaligned along a second direction orthogonal to the first direction.

7. The display method of claim 1, wherein the blocks are in a shape of a square.

8. A display device, comprising:

a display panel comprising a plurality of blocks, each of the blocks comprising a plurality of pixels;

a distance detector; and a processor electrically connected with the display panel and the distance detector, wherein the processor is configured to adjust an image signal according to a user distance between a user and the display device detected by the distance detector; and send the adjusted image signal to the display panel to display an image, wherein:

if the user distance is in a first distance range, the display panel displays the image by a plurality of first pixel groups, leaving a undriven portion of the pixels of each of the blocks, wherein each of the first pixel groups is a first proportion of the pixels of each of the blocks, and a pixel number of the first proportion of the pixels of each of the blocks is less than a pixel number of the undriven portion of the pixels of each of the blocks;

if the user distance is in a second distance range, the display panel displays the image by a plurality of second pixel groups, wherein each of the second pixel groups is a second proportion of the pixels of each of the blocks, wherein the second distance range is less than the first distance range, and the second proportion is greater than the first proportion; and if the user distance is in a third distance range, the display panel displays the image by a plurality of third pixel groups, wherein each of the third pixel groups is a third proportion of the pixels of each of the blocks, wherein the third distance range is less than the second distance range, the third proportion is greater than the second proportion, and the first to third pixel groups comprise a same shape.

9. The display method of claim 1, wherein the blocks are in a shape of a rectangle.

10. The display method of claim 1, wherein the blocks are in a shape of a parallelogram.

11. The display method of claim 1, wherein the blocks are in a shape of a diamond.

* * * * *